US008047907B2

(12) United States Patent
Kane et al.

(10) Patent No.: US 8,047,907 B2
(45) Date of Patent: Nov. 1, 2011

(54) METHOD AND APPARATUS FOR CONDUCTING A GAME OF CHANCE USING PULL-TAB TICKETS

(75) Inventors: Steven N. Kane, Brookline, MA (US); Dow Hardy, Marlborough, MA (US); Mark E. Herrmann, Wellesley, MA (US); Paul LaRocca, Westport, CT (US); Bijan Sabet, Sudbury, MA (US); Jason Yanowitz, Amherst, MA (US)

(73) Assignee: Scientific Games Holdings Limited, Longford (IE)

( * ) Notice: Subject to any disclaimer, the term of this patent is extended or adjusted under 35 U.S.C. 154(b) by 252 days.

(21) Appl. No.: 11/133,153

(22) Filed: May 19, 2005

(65) Prior Publication Data

US 2006/0030388 A1 Feb. 9, 2006

Related U.S. Application Data

(63) Continuation-in-part of application No. 11/001,775, filed on Nov. 30, 2004.

(60) Provisional application No. 60/569,030, filed on May 7, 2004.

(51) Int. Cl.
*A63F 9/24* (2006.01)
*A63F 3/06* (2006.01)

(52) U.S. Cl. ..... 463/16; 273/138.1; 273/139; 273/269; 283/94; 283/901; 283/903; 463/17; 463/29

(58) Field of Classification Search ..... 463/16–20, 463/25, 29, 40, 42; 273/138.1, 139, 138.2, 273/269; 283/94, 901, 903
See application file for complete search history.

(56) References Cited

U.S. PATENT DOCUMENTS

| | | | |
|---|---|---|---|
| 2,544,961 | A | 3/1951 | Kemp |
| 4,215,864 | A | 8/1980 | Nichols |
| 4,494,197 | A | 1/1985 | Troy et al. |
| 4,582,324 | A | 4/1986 | Koza et al. |
| 4,679,789 | A | 7/1987 | Okada |
| 4,689,742 | A | 8/1987 | Troy et al. |
| 4,725,079 | A | 2/1988 | Koza et al. |
| 4,764,666 | A | 8/1988 | Bergeron |
| 4,856,787 | A | 8/1989 | Itkis |
| 4,882,473 | A | 11/1989 | Bergeron et al. |

(Continued)

FOREIGN PATENT DOCUMENTS

CA 2338080 9/2001

(Continued)

OTHER PUBLICATIONS

Rules of Pai Gow Poker. Casino City. Dec. 3, 2000. Online: http://web.archive.org/web/20001203170300/http://www.casinocity.com/rules/paigow.htm.*

(Continued)

*Primary Examiner* — Dmitry Suhol
*Assistant Examiner* — Andrew Kim
(74) *Attorney, Agent, or Firm* — Dority & Manning, P.A.

(57) ABSTRACT

A system and method are provided for playing a game of chance. The game of chance may include, for example, a lottery-type game using a pull-tab ticket. A result of the game of chance is revealed to a player in another medium. In one example, the result is revealed during multiple game instances of one or more online games.

23 Claims, 8 Drawing Sheets

U.S. PATENT DOCUMENTS

| | | | | |
|---|---|---|---|---|
| 4,922,522 | A | | 5/1990 | Scanlon |
| 5,158,293 | A | | 10/1992 | Mullins |
| 5,297,802 | A | | 3/1994 | Pocock |
| 5,324,035 | A | | 6/1994 | Morris et al. |
| 5,333,868 | A | | 8/1994 | Goldfarb |
| 5,351,970 | A | | 10/1994 | Fioretti |
| 5,373,440 | A | | 12/1994 | Cohen |
| 5,377,975 | A | | 1/1995 | Clapper, Jr. |
| 5,398,932 | A | * | 3/1995 | Eberhardt et al. |
| 5,429,361 | A | | 7/1995 | Raven |
| 5,445,391 | A | | 8/1995 | Gleason, Jr. |
| 5,518,253 | A | | 5/1996 | Pocock et al. |
| 5,569,082 | A | | 10/1996 | Kaye |
| 5,586,937 | A | | 12/1996 | Menashe |
| 5,611,729 | A | | 3/1997 | Schumacher |
| 5,628,684 | A | | 5/1997 | Bouedec |
| 5,645,485 | A | | 7/1997 | Clapper, Jr. |
| 5,653,635 | A | | 8/1997 | Breeding |
| 5,679,077 | A | | 10/1997 | Pocock |
| 5,687,971 | A | | 11/1997 | Khaladkar |
| 5,709,603 | A | | 1/1998 | Kaye |
| 5,722,891 | A | | 3/1998 | Inoue |
| 5,749,784 | A | | 5/1998 | Clapper, Jr. |
| 5,768,382 | A | | 6/1998 | Schneier et al. |
| 5,772,511 | A | | 6/1998 | Smeltzer |
| 5,775,993 | A | | 7/1998 | Fentz |
| 5,779,549 | A | | 7/1998 | Walker et al. |
| 5,782,470 | A | | 7/1998 | Langan |
| 5,788,573 | A | | 8/1998 | Baerlocher et al. |
| 5,791,990 | A | | 8/1998 | Schroeder et al. |
| 5,791,991 | A | | 8/1998 | Small |
| 5,797,795 | A | | 8/1998 | Takemoto |
| 5,810,664 | A | | 9/1998 | Clapper, Jr. |
| 5,816,918 | A | | 10/1998 | Kelly et al. |
| 5,823,873 | A | | 10/1998 | Moody |
| 5,823,874 | A | | 10/1998 | Adams |
| 5,830,069 | A | * | 11/1998 | Soltesz et al. |
| 5,848,932 | A | | 12/1998 | Adams |
| 5,857,911 | A | | 1/1999 | Fioretti |
| 5,860,653 | A | | 1/1999 | Jacobs |
| 5,871,398 | A | | 2/1999 | Schneier et al. |
| 5,882,258 | A | | 3/1999 | Kelly et al. |
| 5,887,906 | A | | 3/1999 | Sultan |
| 5,935,002 | A | | 8/1999 | Falciglia |
| 5,954,582 | A | | 9/1999 | Zach et al. |
| 5,980,385 | A | | 11/1999 | Clapper |
| 5,996,997 | A | | 12/1999 | Kamille |
| 6,007,426 | A | | 12/1999 | Kelly et al. |
| 6,012,983 | A | | 1/2000 | Walker et al. |
| 6,015,344 | A | | 1/2000 | Kelly et al. |
| 6,024,640 | A | | 2/2000 | Walker et al. |
| 6,028,920 | A | | 2/2000 | Carson |
| 6,044,135 | A | | 3/2000 | Katz |
| 6,048,269 | A | * | 4/2000 | Burns et al. |
| 6,056,289 | A | | 5/2000 | Clapper |
| 6,059,289 | A | | 5/2000 | Vancura |
| 6,077,163 | A | | 6/2000 | Walker et al. |
| 6,106,393 | A | | 8/2000 | Sunaga et al. |
| 6,113,495 | A | | 9/2000 | Walker et al. |
| 6,146,272 | A | | 11/2000 | Walker et al. |
| 6,152,823 | A | | 11/2000 | Lacoste et al. |
| 6,159,097 | A | | 12/2000 | Gura |
| 6,162,121 | A | | 12/2000 | Morro et al. |
| 6,168,521 | B1 | | 1/2001 | Luciano et al. |
| 6,173,267 | B1 | * | 1/2001 | Cairns ..... 705/14 |
| 6,179,711 | B1 | | 1/2001 | Yoseloff |
| 6,186,892 | B1 | | 2/2001 | Frank et al. |
| 6,193,608 | B1 | | 2/2001 | Walker |
| 6,203,011 | B1 | | 3/2001 | Nulph et al. |
| 6,203,427 | B1 | | 3/2001 | Walker et al. |
| 6,236,900 | B1 | | 5/2001 | Geiger |
| 6,241,606 | B1 | | 6/2001 | Riendeau et al. |
| 6,244,958 | B1 | | 6/2001 | Acres et al. |
| 6,251,017 | B1 | * | 6/2001 | Leason et al. ..... 463/42 |
| 6,270,406 | B1 | | 8/2001 | Sultan |
| 6,273,817 | B1 | | 8/2001 | Sultan |
| 6,279,911 | B1 | | 8/2001 | Cherry |
| 6,280,325 | B1 | | 8/2001 | Fisk |
| RE37,371 | E | | 9/2001 | Gerow |
| 6,283,855 | B1 | | 9/2001 | Bingham |
| 6,287,197 | B1 | | 9/2001 | Dickinson |
| 6,302,793 | B1 | | 10/2001 | Fertitta et al. |
| 6,309,298 | B1 | | 10/2001 | Gerow |
| 6,311,976 | B1 | | 11/2001 | Yoseloff et al. |
| 6,312,334 | B1 | | 11/2001 | Yoseloff |
| 6,358,151 | B1 | | 3/2002 | Enzminger et al. |
| 6,364,765 | B1 | | 4/2002 | Walker et al. |
| 6,364,766 | B1 | | 4/2002 | Anderson et al. |
| 6,368,214 | B1 | | 4/2002 | Luciano |
| 6,368,218 | B2 | | 4/2002 | Angell, Jr. |
| 6,371,852 | B1 | | 4/2002 | Acres |
| 6,375,567 | B1 | | 4/2002 | Acres |
| 6,390,921 | B1 | | 5/2002 | Busch et al. |
| 6,394,902 | B1 | | 5/2002 | Glavich et al. |
| 6,402,614 | B1 | | 6/2002 | Schneier et al. |
| 6,439,995 | B1 | | 8/2002 | Hughs-Baird et al. |
| 6,471,208 | B2 | | 10/2002 | Yoseloff et al. |
| 6,488,280 | B1 | | 12/2002 | Katz et al. |
| 6,514,144 | B2 | | 2/2003 | Riendeau et al. |
| 6,523,829 | B1 | | 2/2003 | Walker et al. |
| 6,527,175 | B1 | * | 3/2003 | Dietz et al. ..... 235/381 |
| 6,540,230 | B1 | | 4/2003 | Walker et al. |
| 6,565,084 | B1 | | 5/2003 | Katz et al. |
| 6,572,106 | B2 | | 6/2003 | Alexoff et al |
| 6,572,107 | B1 | | 6/2003 | Walker et al. |
| 6,575,832 | B1 | * | 6/2003 | Manfredi et al. |
| 6,582,307 | B2 | | 6/2003 | Webb |
| 6,585,590 | B2 | | 7/2003 | Malone |
| 6,588,747 | B1 | | 7/2003 | Seelig |
| 6,595,854 | B2 | | 7/2003 | Hughs-Baird |
| 6,599,187 | B2 | | 7/2003 | Gerow |
| 6,599,192 | B1 | | 7/2003 | Baerlocher et al. |
| 6,607,439 | B2 | | 8/2003 | Schneier et al. |
| 6,612,501 | B1 | | 9/2003 | Woll et al. |
| 6,612,574 | B1 | | 9/2003 | Cole et al. |
| 6,619,660 | B2 | | 9/2003 | Schaefer et al. |
| 6,620,046 | B2 | | 9/2003 | Rowe |
| 6,625,578 | B2 | | 9/2003 | Spaur et al. |
| 6,645,074 | B2 | | 11/2003 | Thomas et al. |
| 6,645,075 | B1 | | 11/2003 | Gatto |
| 6,656,042 | B2 | | 12/2003 | Reiss et al. |
| 6,663,105 | B1 | | 12/2003 | Sullivan et al. |
| 6,676,126 | B1 | | 1/2004 | Walker et al. |
| 6,679,497 | B2 | | 1/2004 | Walker et al. |
| 6,681,995 | B2 | | 1/2004 | Sukeda et al. |
| 6,682,419 | B2 | | 1/2004 | Webb et al. |
| D486,869 | S | | 2/2004 | Webb et al. |
| 6,685,561 | B2 | | 2/2004 | Anderson et al. |
| 6,692,353 | B2 | | 2/2004 | Walker et al. |
| 6,705,944 | B2 | | 3/2004 | Luciano |
| 6,716,103 | B1 | | 4/2004 | Eck et al. |
| 6,719,631 | B1 | | 4/2004 | Tulley et al. |
| 6,729,956 | B2 | | 5/2004 | Wolf et al. |
| 6,733,385 | B1 | | 5/2004 | Enzminger et al. |
| 6,736,324 | B2 | | 5/2004 | Behm |
| 6,749,198 | B2 | | 6/2004 | Katz et al. |
| 6,761,633 | B2 | | 7/2004 | Riendeau et al. |
| 6,780,108 | B1 | | 8/2004 | Luciano |
| 6,811,484 | B2 | | 11/2004 | Katz et al. |
| 6,824,467 | B2 | | 11/2004 | Schlottmann et al. |
| 6,843,724 | B2 | | 1/2005 | Walker et al. |
| 6,852,031 | B1 | | 2/2005 | Rowe et al. |
| 6,855,052 | B2 | | 2/2005 | Weiss et al. |
| 6,866,584 | B2 | | 3/2005 | Michaelson |
| 6,896,619 | B2 | | 5/2005 | Baltz |
| 6,899,622 | B2 | | 5/2005 | Lind et al. |
| 6,910,968 | B2 | | 6/2005 | Nassef et al. |
| 6,913,534 | B2 | | 7/2005 | DeFrees-Parrott |
| 6,918,589 | B2 | | 7/2005 | Thibault |
| 6,929,544 | B2 | | 8/2005 | Osterer |
| 6,934,846 | B2 | | 8/2005 | Szrek |
| 6,942,570 | B2 | | 9/2005 | Schneier et al. |
| 6,969,319 | B2 | | 11/2005 | Rowe et al. |
| 7,008,317 | B2 | | 3/2006 | Cote et al. |
| 7,008,318 | B2 | | 3/2006 | Schneier et al. |
| 7,024,375 | B2 | | 4/2006 | Chau |
| 7,052,394 | B2 | | 5/2006 | Walker et al. |

| | | | |
|---|---|---|---|
| 7,073,720 | B2 | 7/2006 | Behm |
| 7,094,149 | B2 | 8/2006 | Walker |
| 7,112,135 | B2 | 9/2006 | Anderson et al. |
| 7,118,478 | B2 | 10/2006 | Fayter et al. |
| 7,163,459 | B2 | 1/2007 | Tanskanen et al. |
| 7,172,506 | B2 | 2/2007 | Baerlocher et al. |
| 7,179,168 | B1 | 2/2007 | Tulley et al. |
| 7,186,180 | B2 | 3/2007 | Lathrop |
| 7,213,811 | B2 | 5/2007 | Bozeman |
| 7,241,219 | B2 | 7/2007 | Walker |
| 7,275,990 | B2 | 10/2007 | Walker et al. |
| 7,285,045 | B2 | 10/2007 | Schneier et al. |
| 7,294,058 | B1 | 11/2007 | Slomiany et al. |
| 7,303,468 | B2 | 12/2007 | Schneier et al. |
| 7,303,470 | B2 | 12/2007 | George et al. |
| 7,311,599 | B2 | 12/2007 | Knapp |
| 7,357,393 | B2 | 4/2008 | Finocchio |
| 7,416,484 | B1 | 8/2008 | Nelson |
| 7,490,830 | B2 | 2/2009 | Mirandette |
| 2001/0034635 | A1 | 10/2001 | Winters |
| 2001/0046891 | A1 | 11/2001 | Acres |
| 2002/0010015 | A1 | 1/2002 | Acres |
| 2002/0013167 | A1 | 1/2002 | Spaur et al. |
| 2002/0039923 | A1 | 4/2002 | Cannon et al. |
| 2002/0042300 | A2 | 4/2002 | Acres et al. |
| 2002/0052229 | A1 | 5/2002 | Halliburton et al. |
| 2002/0061778 | A1 | 5/2002 | Acres |
| 2002/0077173 | A1* | 6/2002 | Luciano et al. |
| 2002/0090986 | A1 | 7/2002 | Cote et al. |
| 2002/0090987 | A1* | 7/2002 | Walker et al. |
| 2002/0093190 | A1 | 7/2002 | Katz |
| 2002/0094860 | A1 | 7/2002 | Itkis |
| 2002/0098882 | A1 | 7/2002 | Lind et al. |
| 2002/0107072 | A1 | 8/2002 | Giobbi et al. |
| 2002/0111207 | A1 | 8/2002 | Lind |
| 2002/0147040 | A1* | 10/2002 | Walker et al. |
| 2002/0152120 | A1 | 10/2002 | Howington et al. |
| 2002/0155885 | A1 | 10/2002 | Shvili |
| 2002/0169018 | A1 | 11/2002 | Schneier et al. |
| 2002/0187827 | A1 | 12/2002 | Blankstein |
| 2002/0193158 | A1 | 12/2002 | Weiss et al. |
| 2002/0198038 | A1 | 12/2002 | Adams |
| 2003/0013531 | A1 | 1/2003 | Rowe et al. |
| 2003/0027628 | A1 | 2/2003 | Luciano |
| 2003/0032473 | A1 | 2/2003 | Rowe et al. |
| 2003/0032476 | A1 | 2/2003 | Walker et al. |
| 2003/0045340 | A1 | 3/2003 | Roberts |
| 2003/0047869 | A1 | 3/2003 | Walker et al. |
| 2003/0060257 | A1 | 3/2003 | Katz et al. |
| 2003/0060261 | A1 | 3/2003 | Katz et al. |
| 2003/0069068 | A1 | 4/2003 | Kaminkow |
| 2003/0080508 | A1 | 5/2003 | Thibault |
| 2003/0102625 | A1 | 6/2003 | Katz et al. |
| 2003/0114217 | A1* | 6/2003 | Walker et al. |
| 2003/0119581 | A1* | 6/2003 | Cannon et al. |
| 2003/0139214 | A1 | 7/2003 | Wolf et al. |
| 2003/0155715 | A1* | 8/2003 | Walker et al. |
| 2003/0157977 | A1 | 8/2003 | Thomas et al. |
| 2003/0171986 | A1 | 9/2003 | Itkis |
| 2003/0176210 | A1 | 9/2003 | Vancura et al. |
| 2003/0176212 | A1 | 9/2003 | Schlottmann et al. |
| 2003/0186739 | A1 | 10/2003 | Paulsen et al. |
| 2003/0195841 | A1 | 10/2003 | Ginsberg et al. |
| 2003/0199318 | A1 | 10/2003 | Nassef et al. |
| 2003/0218303 | A1* | 11/2003 | Walker et al. |
| 2003/0220138 | A1 | 11/2003 | Walker et al. |
| 2004/0036212 | A1 | 2/2004 | Walker et al. |
| 2004/0038723 | A1 | 2/2004 | Schneier et al. |
| 2004/0051240 | A1 | 3/2004 | Adams |
| 2004/0053683 | A1 | 3/2004 | Hartl et al. |
| 2004/0059445 | A1 | 3/2004 | Moore |
| 2004/0063484 | A1* | 4/2004 | Dreaper et al. |
| 2004/0092307 | A1 | 5/2004 | George et al. |
| 2004/0102238 | A1 | 5/2004 | Taylor |
| 2004/0127279 | A1 | 7/2004 | Gatto et al. |
| 2004/0133472 | A1 | 7/2004 | Leason et al. |
| 2004/0142741 | A1* | 7/2004 | Walker et al. |
| 2004/0147308 | A1* | 7/2004 | Walker et al. |
| 2004/0152510 | A1 | 8/2004 | Herrmann |
| 2004/0180722 | A1 | 9/2004 | Giobbi et al. |
| 2004/0185930 | A1 | 9/2004 | Thomas et al. |
| 2004/0214628 | A1 | 10/2004 | Boyd et al. |
| 2004/0229671 | A1 | 11/2004 | Stronach et al. |
| 2004/0229677 | A1 | 11/2004 | Gray |
| 2004/0259631 | A1 | 12/2004 | Katz et al. |
| 2005/0037841 | A1 | 2/2005 | de Waal |
| 2005/0049042 | A1* | 3/2005 | Walker et al. |
| 2005/0075158 | A1* | 4/2005 | Walker et al. |
| 2005/0090314 | A1 | 4/2005 | Nassef, Jr. et al. |
| 2005/0092839 | A1 | 5/2005 | Oram |
| 2005/0124407 | A1 | 6/2005 | Rowe et al. |
| 2005/0164779 | A1 | 7/2005 | Okuniewicz |
| 2005/0170881 | A1 | 8/2005 | Muskin |
| 2005/0187005 | A1 | 8/2005 | Rose et al. |
| 2005/0258596 | A1* | 11/2005 | Such ..... 273/269 |
| 2005/0282619 | A1 | 12/2005 | Vancura et al. |
| 2005/0282626 | A1 | 12/2005 | Manfredi et al. |
| 2005/0288088 | A1 | 12/2005 | Englman et al. |
| 2006/0025219 | A1 | 2/2006 | Nassef, Jr. et al. |
| 2006/0035696 | A1 | 2/2006 | Walker et al. |
| 2006/0036450 | A1 | 2/2006 | Nassef, Jr. et al. |
| 2006/0041586 | A1 | 2/2006 | Nassef, Jr. et al. |
| 2006/0068893 | A1 | 3/2006 | Jaffe et al. |
| 2006/0073884 | A1 | 4/2006 | Walker et al. |
| 2006/0089194 | A1 | 4/2006 | Joshi et al. |
| 2006/0148562 | A1 | 7/2006 | Walker et al. |
| 2006/0194631 | A1 | 8/2006 | Rowe et al. |
| 2006/0205511 | A1 | 9/2006 | Thomas et al. |
| 2006/0247035 | A1 | 11/2006 | Rowe et al. |
| 2007/0054729 | A1 | 3/2007 | Hornik et al. |
| 2007/0060261 | A1 | 3/2007 | Gomez et al. |
| 2007/0060274 | A1 | 3/2007 | Rowe et al. |
| 2007/0060317 | A1 | 3/2007 | Martin et al. |
| 2007/0060329 | A1 | 3/2007 | Martin et al. |
| 2007/0060330 | A1 | 3/2007 | Martin et al. |
| 2007/0060331 | A1 | 3/2007 | Martin et al. |
| 2007/0060369 | A1 | 3/2007 | Martin et al. |
| 2007/0087834 | A1 | 4/2007 | Moser et al. |
| 2007/0167216 | A1 | 7/2007 | Walker et al. |
| 2007/0173322 | A1 | 7/2007 | Swamy et al. |
| 2007/0265062 | A1 | 11/2007 | Thomas et al. |
| 2008/0032763 | A1 | 2/2008 | Giobbi et al. |
| 2008/0039171 | A1 | 2/2008 | Slomiany et al. |
| 2008/0039173 | A1 | 2/2008 | Walther et al. |
| 2008/0287176 | A1 | 11/2008 | Bennett |

FOREIGN PATENT DOCUMENTS

| | | | |
|---|---|---|---|
| EP | 1746550 | A2 | 1/2007 |
| EP | 1762990 | A2 | 3/2007 |
| EP | 1833014 | A1 | 9/2007 |
| WO | WO 91/06931 | | 5/1991 |
| WO | WO 97/37737 | | 10/1997 |
| WO | WO 99/10057 | | 3/1999 |
| WO | WO 99/16519 | | 4/1999 |
| WO | WO 00/43087 | | 7/2000 |
| WO | WO 00/69535 | | 11/2000 |
| WO | WO 01/14029 | | 3/2001 |
| WO | WO 03/004118 | | 1/2003 |
| WO | WO 03/061795 | | 7/2003 |
| WO | WO 03/084625 | | 10/2003 |
| WO | WO 03/089077 | | 10/2003 |
| WO | WO 03/089082 | | 10/2003 |
| WO | WO 2004/013820 | | 2/2004 |
| WO | 2004/105902 | | 9/2004 |
| WO | WO 2004/114073 | | 12/2004 |
| WO | WO 2005/029279 | | 3/2005 |
| WO | WO 2005/031666 | | 4/2005 |
| WO | WO 2005/079242 | | 9/2005 |
| WO | WO 2006/028820 | | 3/2006 |
| WO | WO 2006/052469 | | 5/2006 |
| WO | WO 2007/035618 | | 3/2007 |
| WO | WO 2007/040707 | | 4/2007 |
| WO | WO 2007/076321 | | 7/2007 |
| WO | WO 2007/145999 | | 12/2007 |
| WO | WO 2008/014334 | | 1/2008 |
| WO | WO 2008/022083 | | 2/2008 |
| WO | WO 2008/022084 | | 2/2008 |

OTHER PUBLICATIONS http://www.powerball.com/powerball/pb_howtoplay.asp, accessed Sep. 14, 2008, All.
Written opinion of the international searching authority (international application No. PCT/US07/76224).
Examiner's first report on application No. 2003298941.
Bejeweled Deluxe, Version 1.87, Developed and published by PopCap Games, Inc., www.popcap.com, http://www.popcap.com/fag/bejeweled/1033/pc/readme.html (1of 8) Feb. 25, 2010 9:14:22 AM.
David, Matthew, Online Games Development in Flash—A Brief History, Apr. 28, 2003, SitePoint, http://articles.sitepoint.com/print/flash-brief-history (1 of 6) Jun. 18, 2010 8:28:50 AM.
H.X. Mel and Doris Baker, Cryptography Decrypted, 2001 Addison Wesly, chapters 9 to 12.
Virginia Lottery games, downloaded from www.archive.org, Apr. 29, 2007.
Pop Cap Games, Bejeweled, Feb. 3, 2005, http://web.archive.org/web/20050203202244/http://www.go2share.net/game/bejeweled/index.htm.
John Scarne, Scarne's Complete Guide to Gambling, 1961, Simon & Schuster, New York, chapter 4 on lotteries, pp. 125-126.
Wikipedia, "Wheel of Fortune (US Game Show)" Wikipedia, Nov. 13, 2007 <http://en.wikipedia.org/wiki/Wheel_of_Fortune_%28US_game_show%29>.
New Jersey, State of, "Wheel of Fortune" New Jersey Lottery, Nov. 13, 2007 <http://www.state.nj.us/lottery/instant/ig409.htm>.
New Jersey, State of, "Lots O' Spots Bingo" New Jersey Lottery, Dec. 6, 2007 <http://www.state.nj.us/lottery/instant/ig340.htm>.

* cited by examiner

METHOD AND APPARATUS FOR CONDUCTING A GAME OF CHANCE USING PULL-TAB TICKETS

RELATED APPLICATIONS

This application is a continuation-in-part of and claims priority under 35 U.S.C. §120 to U.S. application Ser. No. 11/001,775, filed Nov. 30, 2004, entitled "METHOD AND APPARATUS FOR CONDUCTING A GAME OF CHANCE," which claims priority under 35 U.S.C. §119(e) to U.S. Provisional Application Ser. No. 60/569,030, entitled "METHOD AND APPARATUS FOR CONDUCTING A GAME OF CHANCE," filed on May 7, 2004, both of which are herein incorporated by reference in their entirety.

FIELD OF THE INVENTION

The invention relates generally to lotteries and gaming and, more particularly, to systems and methods for conducting lottery-based games or casino-based gaming.

BACKGROUND

There are many different types of games that involve the issuance of a lottery ticket to play a game of chance. Lottery tickets are sold through retailers using machines referred to as point of sale (POS) terminals. These tickets are generally printed at the POS terminal, and are usually issued for some lottery drawing to be performed at a later time. Examples of these types of lottery games of chance include traditional state lottery drawings and multi-state lottery drawings (e.g., PowerBall). Another type of lottery ticket, referred to in the art as instant lottery, includes a pre-printed scratch-type lottery ticket which includes a latex or similar coating that is scratched off by a purchaser (a player), revealing one or more game indicia that determine whether or not the player won the game or series of games as indicated on the ticket. The indication is generally "instant" in that the player knows, when they scratch off the ticket coating, whether or not they won the game.

In addition, there are many online games that can be played using a computer system coupled to a communication network (e.g., the Internet). These games may include traditional games of chance, games of skill, and casino-type games, among others.

SUMMARY

New and more interesting game formats are needed for lottery and casino type games to keep players' interest and therefore result in continued and/or return players. According to one embodiment of the present invention, it is appreciated there is a great deal of effort and expense associated with introducing additional games, especially in the casino area. In particular, as each game is introduced, its features are scrutinized by regulators prior to introduction. It therefore would be beneficial to be able to reduce the regulatory effort involved in introducing new games that are exciting to players to play. To this end, according to one aspect of the present invention, a system is provided having two games, a first one of which is already approved by regulators the outcomes of which are used to drive outcomes of a second game. Because the outcome determination and odds of winning the second game are driven by a previously-approved game, the regulatory hurdles associated with releasing the second game are reduced.

According to various aspects and embodiments of the invention, a method is presented for providing players an enhanced gaming experience. According to one embodiment, it is appreciated that it is beneficial to enhance players' interest in playing games, particularly losing ones. In one embodiment, an illusion is presented to players to provide the illusion of being very close to winning a particular game. For example, in the case of a slot machine, the slot machine result may indicate, in a three-wheel slot machine, that the player received a winning combination of two of the first wheels, and only with the revealing of the last wheel does the player realize that he/she has lost the game. According to one aspect, it is realized that the losing game experience should compel the player to continue playing the game.

Some systems combine lottery-type games and online games. In one such system, a lottery ticket is sold to a player, who then plays a further game using a computer system. In such a game system, the ticket sold to a player includes a code which is correlated to a game seed stored in a computer system upon which a computer game is played. The computer game determines the correlated game seed, and this game seed is mapped to a series of predetermined game states that lead to a predetermined outcome. That is, the code stored on the ticket includes the outcome of the game. In another type of system, the code stored on the ticket is an encoded form of the lottery result, which is then revealed to the player at the end of play of an online game.

According to one example system, prizes may be awarded in association with each item collected in the game (e.g., number of points in a slot machine type game). Therefore, prizes may be distributed among elements or levels during play as well as being distributed among game instances. As discussed, prize distribution may be stored in a database of the server, may be determined by the client (e.g., randomly), or may be stored at any location or be determined by any manner by the client.

According to another aspect of the invention, it is appreciated that conventional methods for playing online games of chance are not secure. In particular, because the result or outcome of the game or predetermined sequence of game states may be encoded on a ticket, the lottery game may be compromised if the winning codes are deciphered. Such a deciphering could occur, for example, by hacking a computer system associated with the online lottery and obtaining a list of winning tickets, or reverse engineering software (e.g., on a PC) where the winning codes or sequence of game states may be stored. Further, it is realized that in such conventional systems, the lottery ticket or the online game software and its data are single points of security failures in the system.

One aspect of the present invention relates to a method for conducting a game of chance. According to one embodiment, a more secure method is provided by which an online game may be played. Instead of placing a game seed that determines a sequence of game states on a ticket (e.g., an instant scratch or lottery ticket), the game states or outcomes may not be placed on the ticket. Rather, the outcomes may be stored in an online database. To this end, a code may be stored on the ticket, the code being used as a decryption key used to find the outcome stored in the database. In particular, there may be a mapping between an outcome code and a corresponding decryption key that is printed on the ticket.

Because the decryption key is placed on the ticket, unauthorized access to the online game is not permitted without the physical ticket. In another embodiment, a portion of the decryption key is placed on the ticket, and another portion is stored in a database associated with the online game. In this manner, security cannot be breached without having both portions of the key (either having the issued ticket portion or the online portion). Thus, a hacker may not compromise a lottery ticket database without the ticket, and, by virtue of having a winning ticket, other winning ticket numbers may not be determined. Access to the online portion of the key may be obtained, for example, by providing some other information (e.g., a serial number printed on the ticket). However, it should be appreciated that the information used to gain access to the online portion of the key need not be printed on the ticket—the information may be provided on some other medium or by another method.

The ticket may be, for example, a scratch-type lottery or "instant" ticket, pull-tab, or type of pre-printed ticket type. Alternatively, the ticket may be a printed lottery ticket as is known in the art, which is a ticket printed at a Point of Sale (POS), usually in the form of a lottery drawing ticket (e.g., PowerBall or other type lottery drawing game). Also, the ticket may be an electronic ticket issued by a computer system. It should be appreciated that the ticket may be any type of ticket issued in any form, and the invention is not limited to any particular ticket type method of issuing a ticket.

According to one aspect of the invention, a scratch-type or pull-tab ticket for playing a game of chance may be issued to a player. According to an embodiment of the invention, an access code and/or ticket identifier may be provided on the ticket and may be covered by scratch-off paint or other material. The outside of the scratch or pull-tab ticket may also have a payout table that lists winning combinations, the payout for a winning combination, and/or odds for a winning combination. According to an embodiment, the ticket combinations that may indicate whether or not the ticket is a winning ticket are printed on the inside of the ticket or in another hidden location. In addition to the ticket combinations, the ticket may include an access code printed thereon that a player may use to access an online game. In one embodiment, the ticket may have no instructions on the outside to indicate the ticket may be opened to reveal the ticket combinations. Therefore, rather than determine the outcome of the ticket game from the ticket itself, the player may use the access code to access the online game, and the outcome of the ticket game may be revealed to the player during or after play of the online game. However, a player using scissors or other means may open the ticket and reveal the ticket combinations. Thus, if the player does not wish to access the online game, the player may reveal the outcome of the ticket game by opening the ticket. According to an embodiment of the invention, the ticket will not be opened for the player by a lottery agent or a lottery machine prior to the ticket being handed to the player.

According to one aspect of the present invention, a method for playing a game of chance is provided. The method comprises acts of issuing a ticket to a player, the ticket including a code printed on a surface of the ticket, and providing for the player to play another game on different medium than the issued ticket, wherein the code is used to gain security access in obtaining results of the game of chance. According to one embodiment of the invention, the act of issuing a ticket includes issuing at least one of a lottery ticket, a scratch ticket, and a pull-tab ticket. According to another embodiment, the act of providing further comprises an act of providing a computer-based game which the player plays to reveal the results of the game of chance. According to another embodiment, the act of providing a computer-based game further comprises an act of permitting access to the results of the game of chance by using the code as a decryption key to obtain the results. According to another embodiment, the method further comprises an act of storing, on a server, the results of the game of chance. According to another embodiment, the method further comprises storing, in a database of a computer system, a portion of a decryption key, the portion being used along with the code by the computer system to obtain the results.

According to one embodiment of the invention, the method further comprises an act of obtaining, from the database of the computer system, the portion of the decryption key based on an identifier printed on the ticket. According to another embodiment, the identifier is a serial number associated with the ticket. According to another embodiment, the method further comprises an act of presenting, to the player, an interface in which the player is permitted to enter the code to obtain security access to the results. According to another embodiment, the another game is a game of chance. According to another embodiment, the another game is a slot machine. According to another embodiment, the another game is a computer-based game involving a grid of elements, and wherein the player removes at least one group of elements by selecting the group within an interface of the computer-based game. According to another embodiment, the ticket discloses the number of slot machine pulls awarded the player.

According to one embodiment of the invention, the prize total for the ticket is predetermined. According to another embodiment, the sequence of reveals is predetermined. According to another embodiment, the reveals are randomly determined by the client. According to another embodiment, the sequence of reveals is stored in a database of a server. According to another embodiment, the method further comprises an act of revealing, to the player, an item associated with at least one of the at least one group of elements when the at least one group of elements is removed. According to another embodiment, the item is used to play a second game. According to another embodiment, the item is used by the player to reveal a prize won by the player. According to another embodiment, the prize won by the player is at least one of cash, merchandise, and credit. According to another embodiment, an indication of the prize won by the player is stored in a database of a server, and is downloaded to a computer presenting the computer-based game to the player.

According to one embodiment of the invention, the method further comprises an act of associating, with the ticket, additional opportunities to win. According to another embodiment, the additional opportunities to win include one or more additional reveals of results associated with the game of chance. According to another embodiment, the one or more additional reveals of results are presented during play of an online game.

According to another embodiment, the method further comprises an act of providing, by a first server associated with a first game, a result associated with the game of chance. According to another embodiment, the method further comprises an act of storing, in a memory of a computer system, the result associated with the game of chance. According to another embodiment, the method further comprises an act of associating the result with an indication of the ticket. According to another embodiment, the indication of the ticket is unique among indicators of a plurality of tickets. According to another embodiment, the first server further comprises a random number generator, and the random number generator performs an act of determining a set numbers associated with the issued ticket.

According to one embodiment of the invention, the method further comprises an act of determining a set of winning numbers associated with the game of chance. According to another embodiment, the method further comprises an act of determining the result of the game of chance based on a comparison of the set of numbers associated with the issued ticket and the set of winning numbers. According to another embodiment, the game of chance includes at least one of a Keno game and a Bingo game, and the act of determining a set of numbers associated with the issued ticket comprises an act of selecting a predetermined number of numbers from a predetermined set of numbers. According to another embodiment, the method further comprises an act of permitting the player to redeem the issued ticket without playing the game on the different medium. According to another embodiment, the sequence of reveals is determined by a predetermined game script. According to another embodiment, the sequence of reveals is determined dynamically by a game playing computer system. According to another embodiment, the method further comprises an act of determining a predetermined game script where a magnitude of prizes awarded for reveals associated with later win opportunities are progressively greater than the magnitude of prizes associated with reveals associated with earlier win opportunities.

According to one embodiment of the invention, the method further comprises an act of determining, for an issued ticket indicated as a losing ticket, a game script comprising an indication that the player was substantially close to winning. According to another embodiment, the player must wait a predetermined time period before redeeming the ticket. According to another embodiment, the player must wait until a specific event has been completed before redeeming the ticket. According to another embodiment, the player must wait until a specific event has been completed before gaining access to obtain results associated with the ticket. According to another embodiment, the issued ticket discloses a number of game instances awarded to the player. According to another embodiment, the prize total for the ticket is determined after the ticket is issued to the player. According to another embodiment, the method further comprises an act of determining an outcome associated with the ticket based on a drawing. According to another embodiment, the method further comprises an act of permitting the player to play the another game in response to the act of determining the outcome. According to another embodiment, the prize total for the ticket is determined prior to issuing the ticket to the player.

Further features and advantages of the present invention as well as the structure and operation of various embodiments of the present invention are described in detail below with reference to the accompanying drawings.

BRIEF DESCRIPTION OF THE DRAWINGS

The accompanying drawings are not intended to be drawn to scale. In the drawings, each identical or nearly identical component that is illustrated in various figures is represented by a like reference numeral. Additionally, the left-most one or two digits of a reference numeral identifies the drawing in which the reference numeral first appears. For purposes of clarity, not every component may be labeled in every drawing. In the drawings.

DETAILED DESCRIPTION

Figure 1:
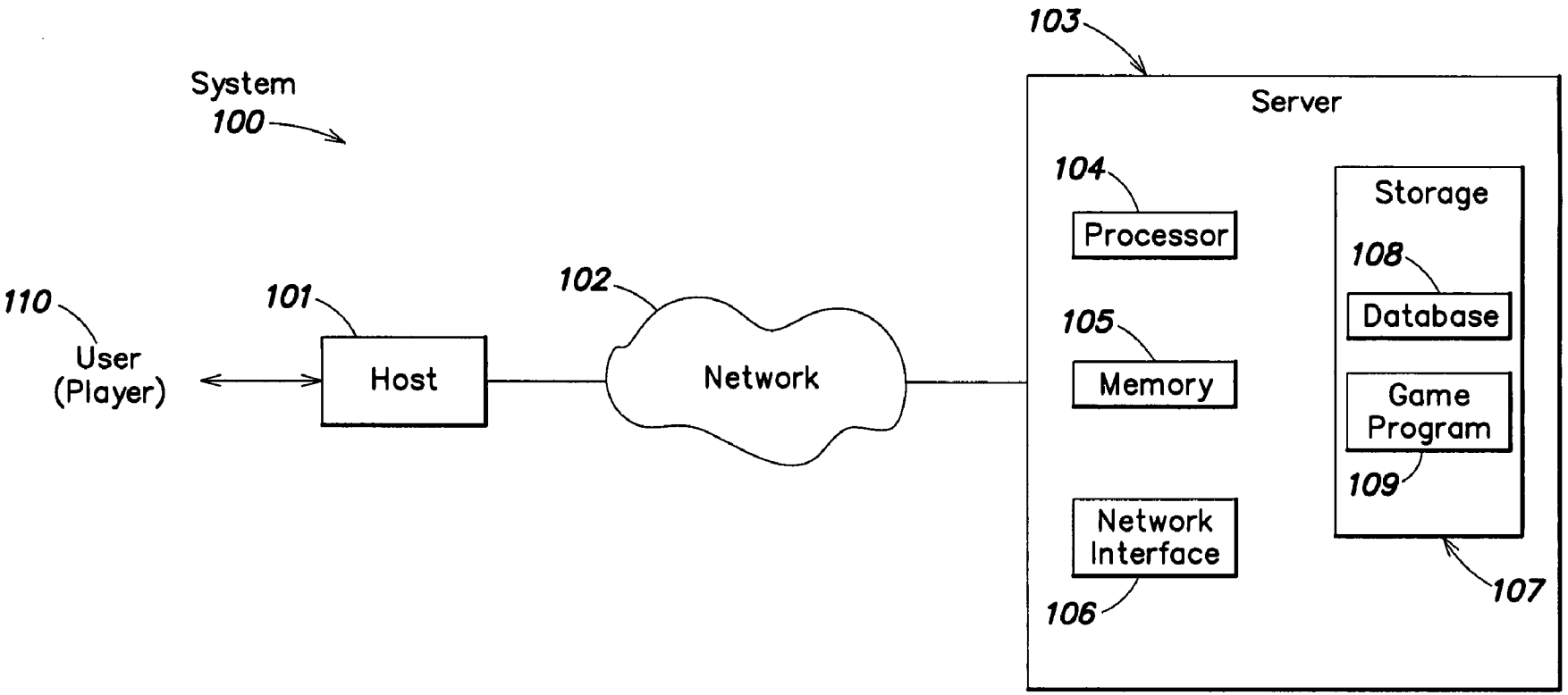
FIG. 1 is block diagram of a system for conducting a game according to one embodiment of the present invention.

According to various aspects and embodiments of the present invention, a player is permitted to play a computer-based game (referred to hereinafter as a "primary" game) during which the game playing system reveals results of another game (referred to hereinafter as a "secondary" game). This secondary game may be a casino or lottery-based game and, according to at least one embodiment, the secondary game is already approved by regulators. One such game is the well-known game of Keno. However, it should be appreciated that the secondary game may be any other type of game (e.g., a lottery game). The primary game may be any type of computer-based game, including games of skill and/or chance, such as card games, casino games, video games or any other type of game through which a result from another game may be revealed. In one aspect of the present invention, the play of the primary game that the player plays does not affect the outcome of the secondary game. In another aspect of the present invention, the secondary game result does not affect the outcome of the primary game played by the player.

Aspects and embodiments of the invention are described below with reference to the accompanying figures. It is to be appreciated that the invention is not limited in its applications to the details of construction and arrangement of components discussed below and illustrated in the drawings. Rather, the invention is capable of being practiced in many ways and the following description is given for the purposes of example and explanation. Also, the phraseology and terminology used herein is for the purpose of description and is not intended to be limiting. The use of "comprising," "including," "having," "containing," "involving" and variations thereof is intended to encompass the items listed thereafter as well as additional items.

According to one embodiment, an improved game experience is provided by using an online primary game to reveal the result of a secondary game, such as a game of chance and/or a ticket game associated with a scratch-type or pull-tab ticket. For example, a player may purchase a ticket or other game piece at a POS or other location. This ticket may be associated with a ticket game such as a lottery game or a sweepstakes. In addition, on the ticket, one or more plays of an associated online primary game may be provided. The player can play those one or more plays across a set of online games. For example, the set of games may include games of skill and/or chance as discussed further below. Certain games may include one or more attempts (or opportunities) for winning and these opportunities for winning may be associated with one or more prizes.

During or after play of the online primary game(s), a result of the ticket game may be revealed to the player. Thus, play of the ticket game (the secondary game) may be enhanced both by prolonging the time until the result of the ticket game is revealed (as opposed to a traditional scratch-type ticket wherein the player may immediately find out a result of the game by scratching the ticket) and by providing the player with access to one or more online games.

In one example, the primary game involves some level of influence by the player on the outcome of the primary game. For example, the primary game may be a game of skill. However, it should be appreciated that the primary game be a game based on chance, or combination of skill and chance. In one example, the primary game may be similar to the well-known game of COLLAPSE (COLLAPSE is a trademark of GameHouse, Inc., Seattle Wash.) and its variations. As is known, COLLAPSE is a game of skill that allows the player to earn points by removing elements from a game grid. COLLAPSE and similar games involve a window having a grid having colored elements where new lines of the grid are fed into the bottom of the grid periodically. A player removes groups of three or more similarly-colored elements by selecting them within the grid. The player may be permitted to play the game of COLLAPSE (or similar game), during which the result of the primary game is revealed over one or more instances of the COLLAPSE-type game. However, it is to be appreciated that the invention is not limited to the primary game being a COLLAPSE-type game and any other computer-based game may be used as the primary game. In addition, it is to be understood that the term "online" game as used herein is intended to refer to any type of computer-based game including, but not limited to, games that may be played over a network connection such as the Internet.

The secondary game may be any type of game and in one preferred embodiment may be a game of chance such as a ticket-based lottery-type game, or another game such as the well known games of Keno, Bingo or Bonanza-Bingo. For clarity, the secondary game may be referred to herein as a "ticket game" however, it is to be appreciated that the secondary game may also be implemented using a game piece that is not a ticket.

As discussed above, in one embodiment, the secondary game may be a game that is already approved by appropriate gaming regulators. Such a secondary game may be, for example, a game whose results are driven by a random number generator (RNG), such as the games of Keno, Bingo and Bonanza-Bingo, or it may be a lottery-type game associated with, for example, scratch-and-win tickets. In one example, a Keno game and its associated system are used to generate reveal results which are revealed to a player during play of an online game. To this end, a Keno-based system may be used in conjunction with an online gaming system to present new and interesting online games whose outcomes are driven by results provided by the Keno system. In one particular example, a Keno system provides a correlation of a ticket identifier to a Keno game which is held at some predetermined time. As the Keno numbers are drawn, an outcome is produced associated with the particular ticket identifier and provided to an online gaming system. The online gaming system uses the produced outcome to render a new and interesting gaming experience within an online gaming environment. As discussed, such an environment may include online play of one or more online games of skill, chance, or combination thereof.

As discussed above, according to one embodiment, the secondary game may be a ticket game associated with a scratch or pull-tab ticket. It is to be appreciated that the term "pull-tab ticket" may be used herein to refer generally to tickets that conceal aspects of the tickets game, including but not limited to pull-tab tickets, scratch tickets and other types of game pieces.

Figure 2:
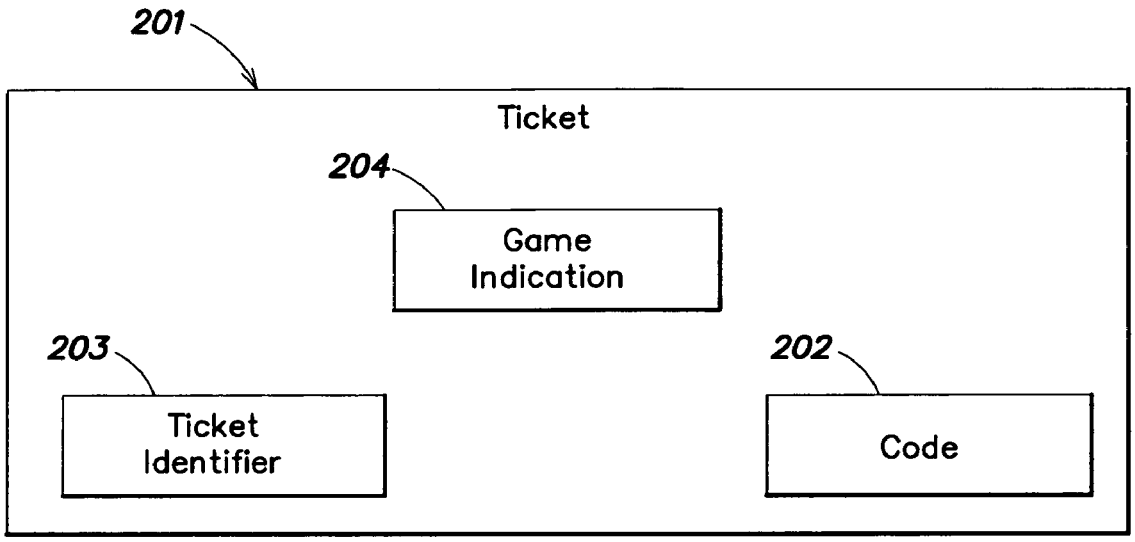
FIG. 2 is an example ticket that may be issued in association with a game according to one embodiment of the present invention.

Referring to FIG. 2, there is illustrated example ticket 201 that may be issued to a player. The player may scratch a surface of the ticket (in the case of a scratch ticket) to reveal one or more indications. These indications may include, for example, a serial number of the ticket, an access code, or other indication (or combination thereof) that may be used to access the online game. Alternatively, the ticket may be a pull-tab ticket or other ticket type suitable for presenting indications to a player.

The ticket may include other indications (e.g., a decryption key or portion thereof as described above that may be used to decrypt game results). Also, the ticket may indicate to a player the number of plays of a second game (e.g., as played by the player on a computer system). For example, in the case of a slot machine game, the ticket may indicate the number of spins that a player may be awarded by the ticket. In the case of a COLLAPSE-type game, the ticket may indicate the number of game instances (or plays) of the COLLAPSE-type game that can be played by the player. Further, as discussed above, the player may be permitted to play any one of a number of offered games, and the player may select different games to play to reveal results associated with game instances.

In one embodiment, ticket 201 includes a code 202 printed on a surface of the ticket that provides access to outcomes (e.g., prizes) stored on the server. As discussed, code 202 may also include, as an optional feature to increase security, a key that may be used to decrypt the outcome. This outcome may be stored in a database stored on a server system. Ticket 201 may also include a ticket identifier 203 used to identify the ticket, and which may be used to identify the outcome associated with the ticket. Further, ticket 201 may include a game indication 204 that relates information relevant to a game played on a computer system. For example, there may also be stored, on the ticket, an identifier that indicates, to the player, the number of plays associated with an online game. In one example, a player purchases a ticket at a retailer or other POS location.

Figure 7:
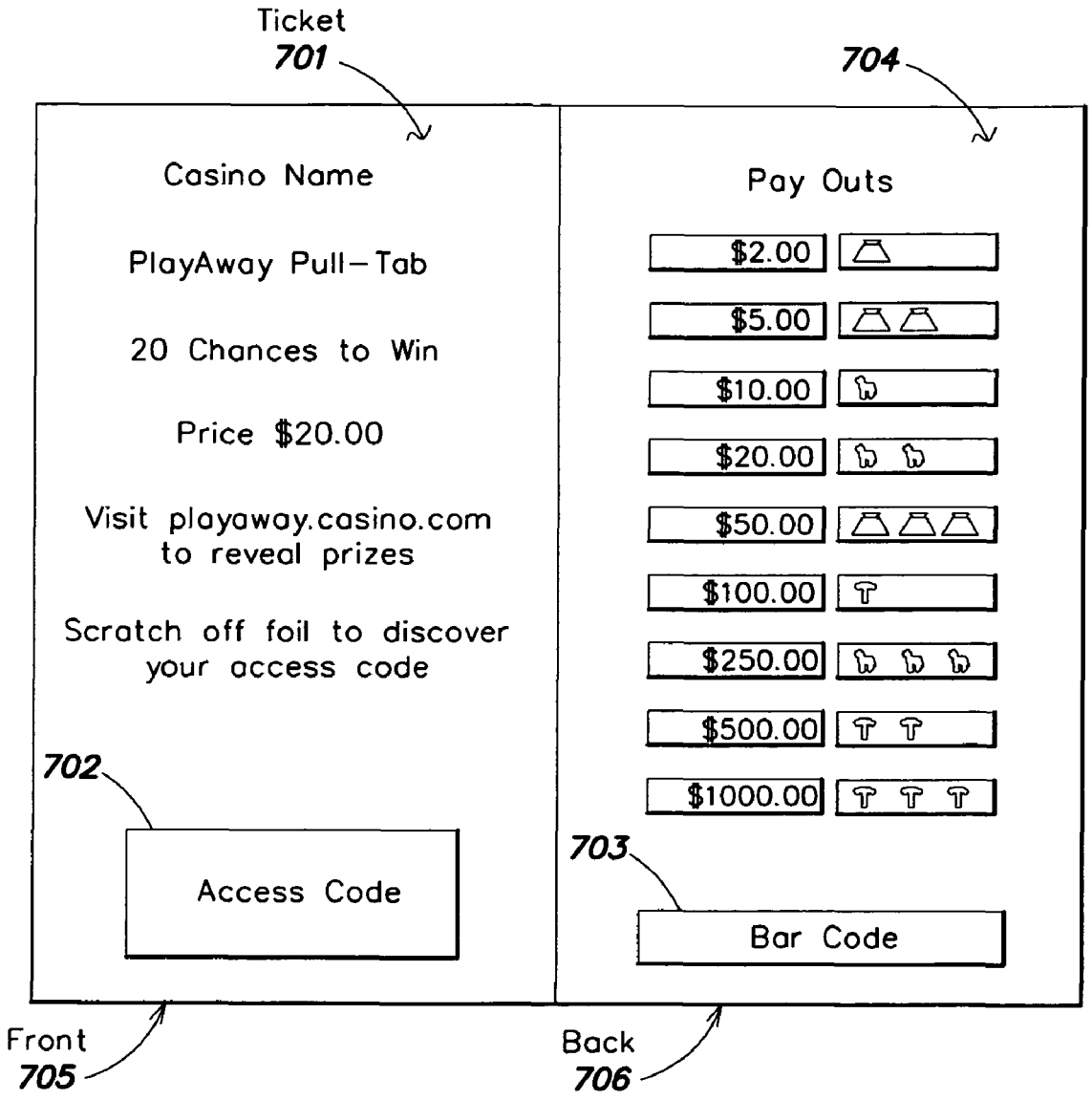
FIG. 7 is an example of the front and back of a ticket that may be issued in association with a game according to one embodiment of the present invention.
Figure 8:
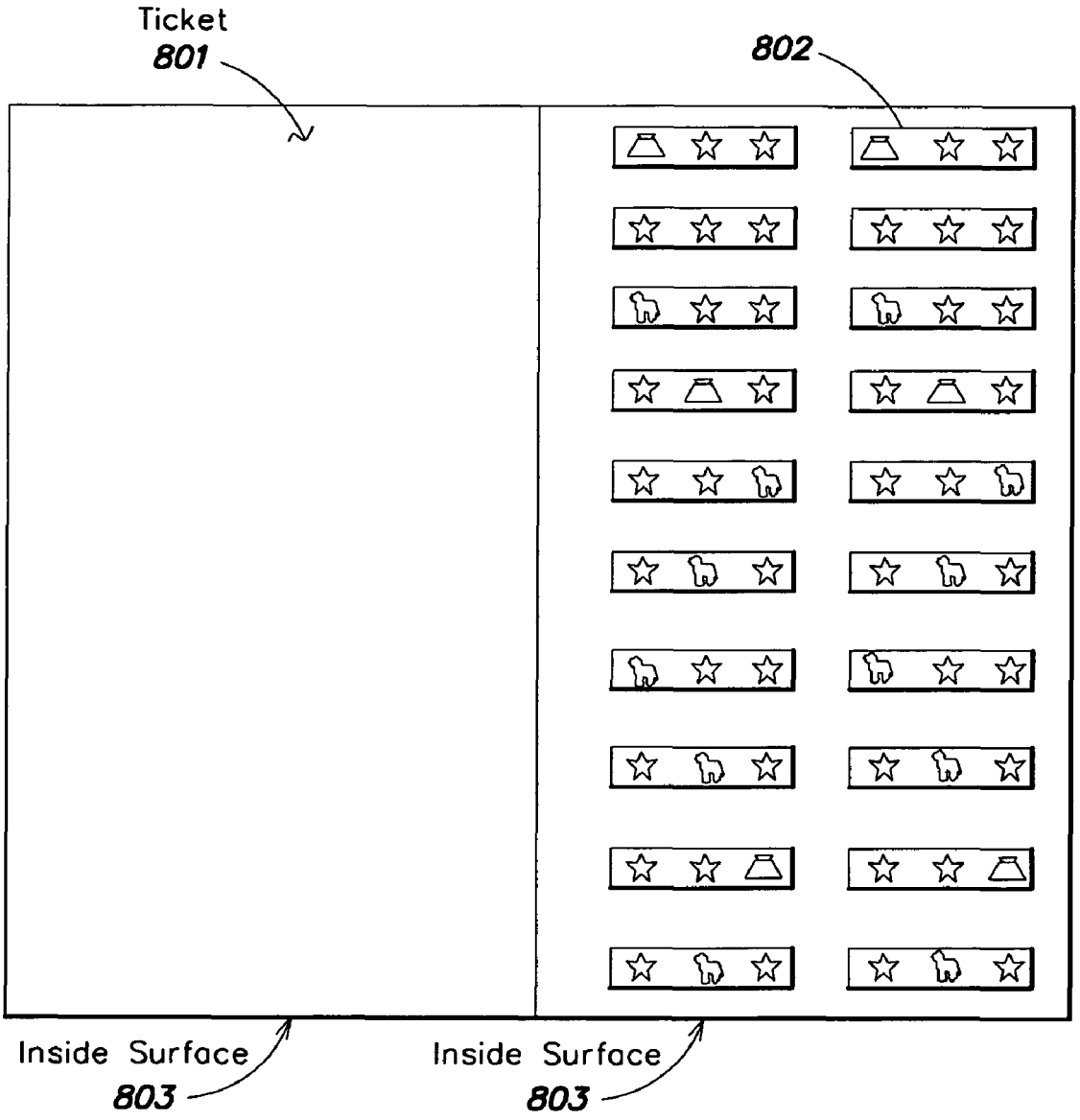
FIG. 8 is an example of the inside of a ticket that may be issued in association with a game according to one embodiment of the present invention.

FIGS. 7 and 8 show an example pull-tab tickets 701, 801 that may be issued to a player. In one example, ticket 701 may include front 705 and back 706 surfaces upon which surfaces upon which various indicia may be printed. The ticket may be issued to the player for playing in a lottery or in any other game of chance operated by a governmental agency (e.g., a state lottery agency), casino, or gaming club. The access code 702 may have a similar function to code 202 described above. The bar code 703 may have a similar function to ticket identifier 203 described above. In one example, the bar code 703 may be any alternative method for identifying the ticket. The outside of ticket 701 may also have a payout table 704 that lists all the winning combinations and the payout for the winning combination.

Ticket 701 may include an inside surface upon which further indicia may be printed. For example, FIG. 8 shows a ticket 801 similar to ticket 701, having an inside surface 803 upon which various indicia may be shown. For example, on the inside surface 803 of ticket 801, ticket combinations 802 are printed. In one example, combinations 802 may include one or more columns of information. In one example, ticket 801 may include two columns wherein the second column is printed as a check to ensure the first column is correct. If the indicia in the first column 802 matches that shown in the second column, the indicia shown in the first column may be deemed correct. For ticket 801, the winnings are $44.00 based upon the payout table 704 if all combinations shown are played.

According to one embodiment, ticket 701 may be sealed and may have no indication that the ticket combinations 805 are printed on the inside of the ticket. Thus, ticket 701 may not have any perforations, pull tabs, or cutting lines shown on the outside. The ticket 701 may also have no instructions on the outside to indicate the ticket may be opened to reveal the ticket combinations 805. However, a player using scissors or other access method may open the ticket 701. The ticket 701 will not be opened for the player by the lottery agent or a lottery machine prior to the ticket being handed to the player. Thus, the player may have no indication from the ticket itself that the ticket combinations may be revealed from the ticket. Instead, the player may use the access code 702 to reveal the ticket combinations via an online game. In one example, the player may enter the access code into a computer system interface to access an online game and to reveal an outcome of the ticket game (e.g., to view the ticket combinations). The outcome of the ticket game may be revealed during of after play of the online game, as discussed further below.

According to another embodiment, access code 702 may be hidden by a pull tab, scratch-off paint, ink, coating or may be hidden by any other material or method. Bar code 703 may also be similarly hidden. However, a pull tab to reveal the access code 702 or bar code 703 may not reveal the ticket combinations 705 printed on the inside. An advantage of not revealing the ticket combinations from the ticket directly is that players are encouraged to play the online game to reveal the outcome of the ticket game. This may be beneficial to advertisers and/or game operators because more players may be attracted to the online gaming environment.

After the player has purchased a ticket and thus received a code to access an online game, the player then proceeds to play the online game (the primary game) on a computer system. FIG. 1 shows an example system 100 according to one embodiment of the invention upon which a game may be played. The user (a player) 110 plays a game through an interface of a host computer system (e.g. host 101). Host 101 may be any type of computer system that is capable of playing a game. The host may be, for example, a general-purpose computer system (e.g., a personal computer (PC)) that connects to a network (e.g., the Internet). Other general purpose computer system types (e.g., a PDA, a cell phone, set-top box, or other system type) may be used to play the game.

The computer system may be coupled to a server system 103 through one or more communication networks 102. The server may provide a game program 109 that is executed by host 101 for playing the game. More particularly, game program 109, when executed, may provide an online game that can be played by a user through an interface associated with host 101. This online game may be, for example, a video slot machine, blackjack, or other online or casino-type game.

The game program may be stored, for example, in a computer-readable medium (e.g., a memory, storage, or other media) associated with server 103 that provides game programs. For example, the game program may be stored on a web server and downloaded to a client computer over the Internet. Game program 109 may be one of a number of game programs associated with an online game experience. Different game programs may be selectively downloaded to the client, based on the type of game ticket issued, the game selected for play by the user, the type of client used, or other criteria.

Server 103 may also be a general-purpose computer system, or any other type of computer system capable of authenticating tickets, providing game programs, and performing other game-related functions. Further, it should be appreciated that various game functions may be performed by one or more server systems. Server 103 generally includes a processor 104 for executing server-based game functions. Server 103 may also include a memory 105 for storing data associated with game programs. Server 103 may also include one or more network interfaces 106 that couple server 103 to network 102, which permit server 103 to communicate with one or more hosts. Further, server 103 may include one or more storage entities 107, including disks or other media for storing data. In one embodiment, storage 107 is adapted to store one or more game programs 109 as discussed above. Server 103 may have any number or type of processor that executes an operating system and one or more application programs. In one embodiment, server 103 provides web server content to one or more clients for the purpose of accessing and playing the game.

Server 103 may also include a database 108 that is adapted to store one or more outcomes associated with a ticket or other gaming piece. As discussed, these ticket game outcome may be indexed using an identifier of the ticket.

Figure 3:
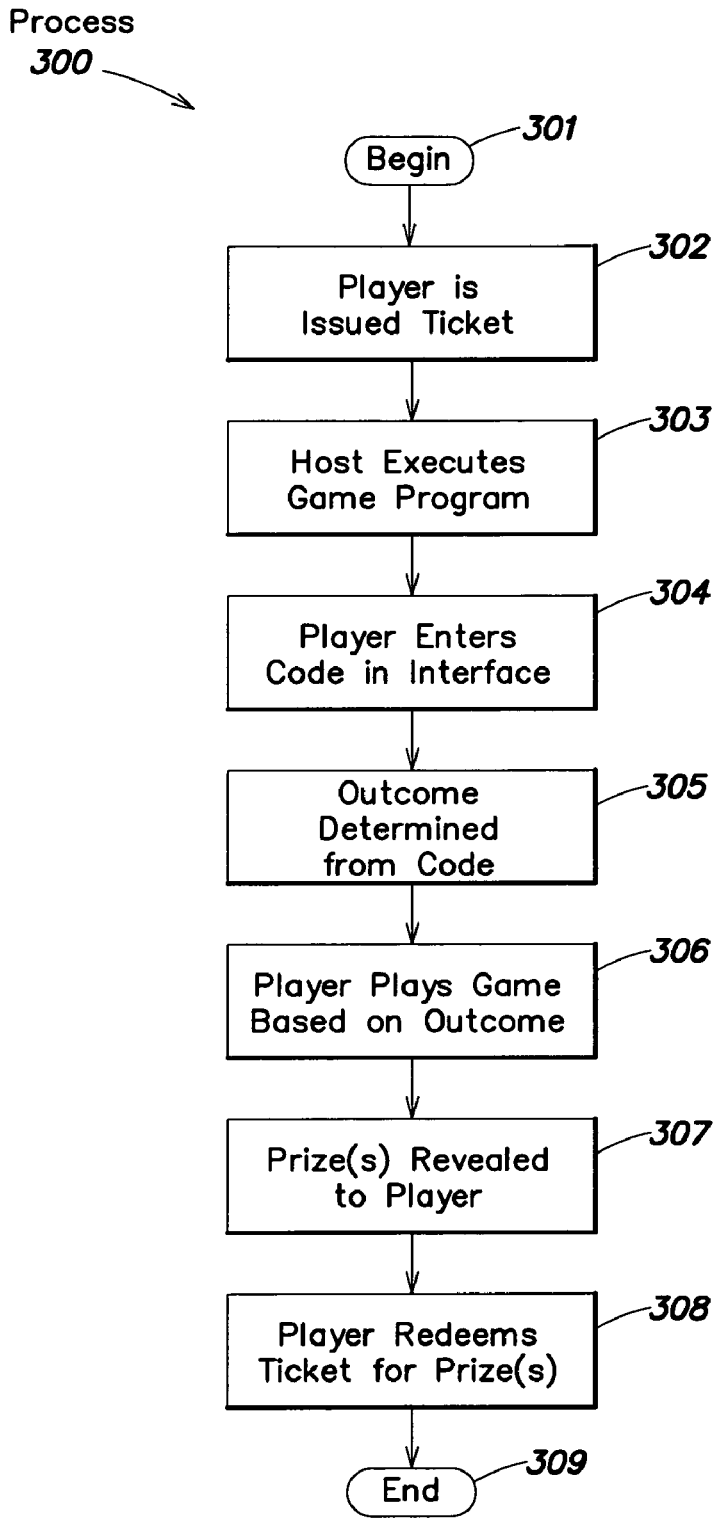
FIG. 3 is a flow chart of one example of a process for conducting a game according to one embodiment of the present invention.

FIG. 3 shows one example process for conducting a game according to one embodiment of the present invention. At block 301, process 300 begins. At block 302, a player is issued a ticket. As discussed, a player may purchase a ticket at a retailer or other POS location. At some later time and/or location, the player may play an online game on one or more computer systems (e.g., a PC or other computer system capable of playing games). For example, at block 303, a host computer system (e.g., host 101) executes a game program. The game program may be, for example, an online game that includes one or more components downloaded over a communication network (e.g., the Internet).

In one example, the ticket may include a code which is used to access the outcome of the game associated with the ticket (the ticket or secondary game). This code may be printed on a face of the ticket as discussed above with reference to FIGS. 2 and 7. In one example system, the player accesses a website that includes an interface in which the player may enter the code at block 304. This interface may be, for example, used to access the game, or may be any other interface (e.g., an interface used to access a download website used for downloading game software (e.g., game program 109)). The interface may be programmed in one or more computer languages (e.g., an HTML, Java, Macromedia Flash, or other type interface) and may include a text entry box in which the player can input the code. The interface may include other ways of entering a code or other parameter (e.g., a glyph printed on a ticket) that allows the user to gain access to the online game. It should be appreciated that the invention is not limited to any particular method for entering the code, or any format of the code, and that any type of code or method of entry may be used.

In one embodiment, the computer system may include a code generator that generates the access codes to be printed on the ticket. The access codes may be generated using, for example, a random number generator. The access codes may be collected and provided from the computer system to a game operator that produces the tickets. It is to be appreciated that the access codes may be provided to the game operator in any format required by the game operator such that the game operator may, for example using another computer system, print an access code on each ticket. In one embodiment, the code generator may produce more access codes than the number of tickets to be printed. For example, the code generator may produce 50% more access codes than a given ticket printing run is expected to need. This may be advantageous in that provides extra codes so as to allow for errors in the ticket printing process. For example, an access code may be printed on a ticket that is then destroyed during a cutting or further printing operation. If the code generator has produced extra codes, another ticket may simply be generated to replace the destroyed ticket without the game operator needing to request an additional access code from the computer system. In addition, the game operator may shuffle the access codes provided by the computer system and randomly select the access codes to be used, thereby preventing anyone who accesses the code generator from determining which codes have been assigned to tickets. This may make the games more secure. In one example, the access codes may be transferred to and from the code generator (to and from the game operator) using a secure transfer protocol such as the well-known SCP program.

According to one embodiment, the player enters the code, and an outcome of the secondary game is determined at block 305 based on the code. More particularly, there may be a mapping between the code printed on the ticket and an outcome of the secondary game that is stored on the server. This code may be stored, for example, in a database structure stored in database 108 of the server. Database 108 may be, for example, a relational database, object database, flat file database, or other organizational entities used to store and maintain data. Further a listing of winning codes may be furnished to an organization that provides the ticket game (such as, for example, a state-run lottery commission). The code may, as discussed above, include an optional decryption key that decrypts an entry stored on the server. This entry may indicate one or more outcomes of ticket game instances.

In one embodiment, the outcome of the ticket game then may be used by the online game to determine play of the online game by the player at block 306. For example, if the stored ticket game outcome is "Win $50," the online game may present an outcome to the player that indicates that the player won a $50 prize. This presentation may be in the form of one or more reveals presented to the player while playing the online game at block 307. The presentation may be progressive, in that the ultimate outcome (e.g., "Win $50") is achieved through a set of reveals or progressions through the online game.

Figure 6:
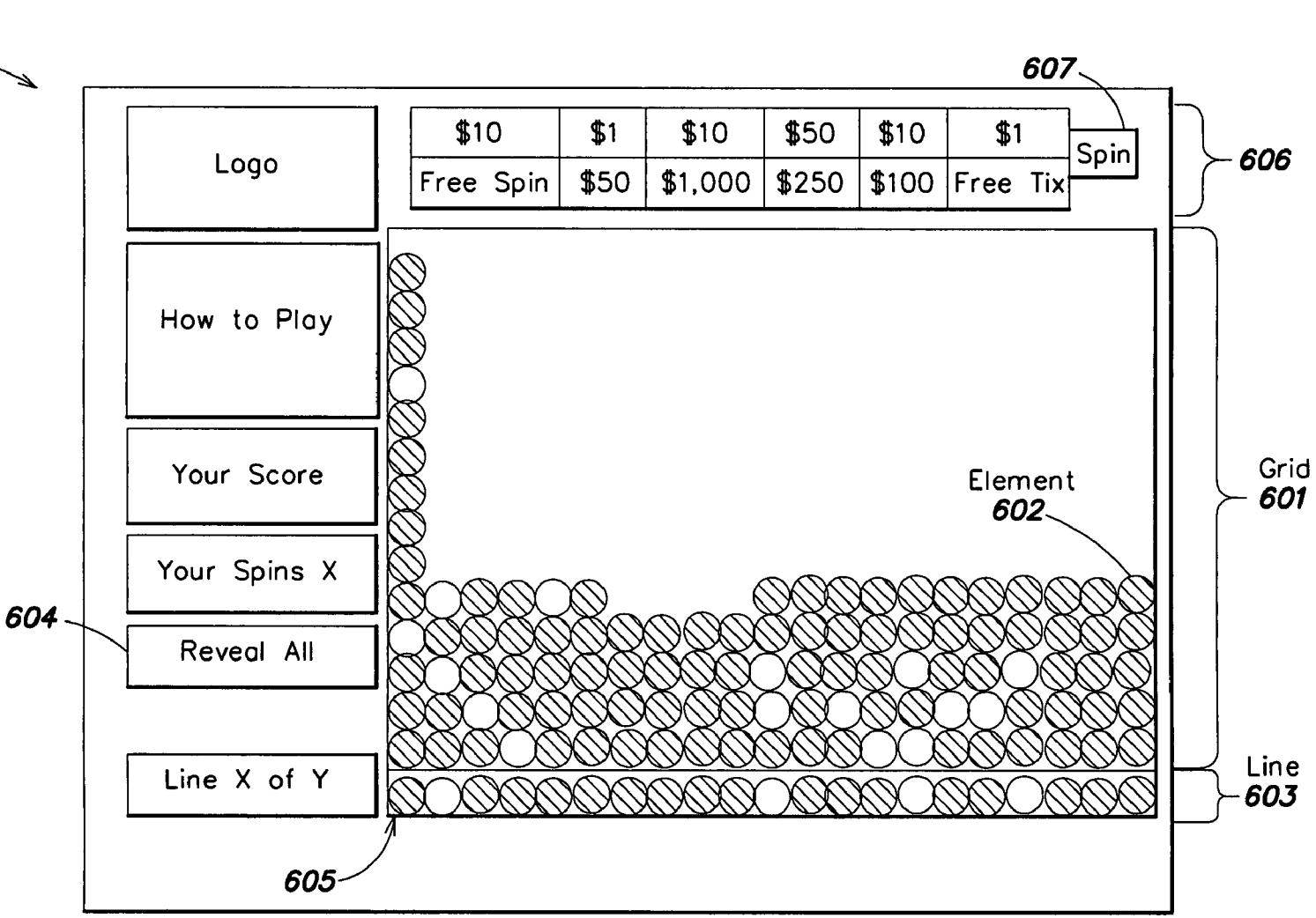
FIG. 6 is an example of a game interface according to one embodiment of the present invention.

FIG. 6 shows an example game interface 600 according to one embodiment of the present invention. The COLLAPSE-type game involves an interface 600 that has a grid 601 of elements (e.g., element 602). Similar elements within grid 601 may be identified by color, shape, or any other indication. One or more new lines of elements (e.g., line 603) are fed into the bottom of the grid periodically.

A player removes groups of similar elements by selecting them within the grid, and the player is awarded points based on the number of elements removed. For example, similar elements may be indicated by color, and groups of similarly-colored elements may be removed from the grid. In one example, groups of three elements can be removed. Removal of larger groups of similarly-indicated elements may provide more points than smaller groups. It should be appreciated, however, that elements may have one or more indications that represent that they are similar, and the invention is not limited to any particular indication(s). Further, it should be appreciated that any number of elements may be removed as part of a group, and the invention is not restricted to any minimum number of element that may be removed.

Lines are moved into a preview area 605 associated with interface 600 that permits the player to anticipate what element types are being placed into grid 601. Lines of elements may be moved into the grid at a predetermined rate, and the rate may be adjusted from time to time during game play. In one example, elements may be fed into the preview area from left to right, and when a line of elements is complete, the line of elements is pushed into grid 601. The COLLAPSE-type game ends when the grid overflows with elements or a final line (e.g., of a predetermined number of lines) is fed into grid 601.

In one embodiment of the present invention, the traditional game of COLLAPSE or similar game may be coupled with a second level game. Play of the second level game may proceed after some achievement level in the COLLAPSE-type game. For example, points may be awarded in the COLLAPSE-type game, and in one embodiment, the second level may proceed after the player achieves a particular point total as further discussed below. Alternatively, the player may play the COLLAPSE-type game until completion, and at the end of the COLLAPSE-type game, the player begins playing the second level game.

As an additional option, a player may bypass play of the COLLAPSE-type game by selecting a "Reveal All" element 604 within interface 600. Selection of element 604 may cause the COLLAPSE-type game to end and may allow the player to progress to a second level game.

In one embodiment, during the play of the COLLAPSE-type game, one or more items may be awarded to the player for use in the second level game. For example, the grid may contain one or more hidden or visible items that may be collected during play. In one example, items may be awarded when particular one(s) of the elements are removed from the grid. In the example of the COLLAPSE-type game, there may be an indication that one or more of the elements of the grid contains an item (e.g., one that may be used with a second level game). This indication may be, for example, a graphical, textual, or other symbolic indication that the element contains an item.

Thus, in one embodiment, the second level of the game may be played with items collected during the COLLAPSE-type game. These items may be hidden within elements of the grid (e.g., grid 601) and released as elements are removed. The type of hidden item may not, according to one embodiment, be known by the user until the hidden item is revealed during game play. In one example, when the element having the hidden item is selected (or removed from the grid), the game program displays the item to the player. In one version of the game, items such as spins of a wheel or sticks of dynamite (a.k.a. "hotsticks") are located within elements in the grid. In addition. In one example game, the items revealed during the game of COLLAPSE are used to open hidden items in a second level game. For example, the second level game includes a series of safes (or other element type) which are opened (and their hidden items revealed) with items collected during the play of the COLLAPSE-type game. In one example, the items are representations of sticks of dynamite that are used by the user to open the safe. However, it should be appreciated that the items may be any type of item that can be used in a second level game.

In another embodiment, items (spins, sticks, etc.) that are accumulated may be used in a second level reveal-type game to reveal a payout or other type of prize. As shown in interface 600, there may be a prize window 606 in which prizes are awarded. In one example, hidden items revealed during the second level of play may be, for example, a cash prize awarded for a particular game. It should be appreciated, however, that other prizes may be awarded (e.g., merchandise, credit, free play, etc.) and that the invention is not limited to any particular prize type.

Window 606 may indicate a number of available prizes, and may include an interface control (e.g., spin control 607) that allows the player to initiate the second level of the game. Window 606 may be a part of or separate from a window that includes grid 601. After the player selects control 607, window 606 indicates what, if any, prize is won. Interface 600 may also include an indication of the number of spins or other items remaining to be played by the player in the second level game.

In the example game discussed above having one or more elements containing hidden items (e.g., safes), sticks of dynamite or other items collected may be used to uncover the hidden prizes in the second level portion of the game. For example, winnings (e.g., cash prizes) revealed within opened safe elements are awarded to the player. In one example, the reveal of the number of sticks awarded to a player may be randomized by the client computer, with at least one stick awarded to the player to allow the player to open at least one safe.

According to one aspect of the present invention, prizes revealed during the second level game may be stored in a database of the server and downloaded to the client prior to play. In this example, the player may be allowed, when a ticket is purchased at a POS, the ability to play a number of instances of the game. Prizes may be awarded, for example, at each instance of the second level of the online game. To this end, the result of each prize may be stored in the database of the server, and may be indexed by an identifier of the ticket. For example, the identifier may be a serial number or other ticket-identifying information.

According to one aspect of the present invention, prizes are only awarded in the second level game. In another example, after a prize is revealed (or not) in the second level game, the player is permitted to play any remaining instances of the primary game (e.g., a slot-machine type game or COLLAPSE-type game). According to another embodiment, the player may not be permitted to replay game instances after they have been played. To this end, a game-playing system may maintain a status of the game instances played by the player. The game-playing system may maintain other information, such as game play information, how prizes are revealed to the player, and other information that may be useful for assessing or auditing game play and playing experiences of the player.

After play of the second level game, game play may be returned to another instance of the first level game (e.g., the COLLAPSE-type game). The player may, however, choose to play a different game (e.g., a card game or other game) at the conclusion of any particular game instance. The player may be permitted to play further instances of the COLLAPSE-type game, with each level of the COLLAPSE-type game leading to a second level wherein prizes are revealed. These intermediate prize amounts that are revealed with each instance of the COLLAPSE-type game, as discussed above, may be stored in a database of the server, and provided to the client prior to or during game play. Alternatively, intermediate prize amounts may be determined at the client in a random manner (e.g., by randomly selecting a possible combination of intermediate prize amounts that total the overall prize awarded to the player). In another example, a game may be determined dynamically by the game system or client based on one or more rules. These rules may be tailored so that the overall result is revealed by the game system in an interesting way.

For example, according to one embodiment, prizes may be distributed over game instances and/or items (or more generally, win opportunities) to maximize game interest and to entice the player to play each game instance associated with a particular ticket. For example, one approach may include providing to the player an early (relative in the series of game instances) indication of winning to keep the player interested. As the player plays more game instances, the magnitude of the prizes may be adjusted such that a level of game "drama" is increased. That is, prize values are adjusted among later game instances to provide relatively higher prize values in later games. Other approaches or distributions may also be provided for increasing or maintaining game interest.

In one example, the ticket may have an overall prize value of $50, and the prize awarded at each instance of the COLLAPSE-type game may accumulate to form the $50 prize. Thus, each instance of the game may include an associated prize (or not), and these prizes may be combined for an overall prize associated with the ticket. In one example, the prize associated with the first instance of the COLLAPSE-type game and its second level is $10. A prize associated with a second instance of the COLLAPSE-type game and its second level is $15.

There may be a finite number of combinations based on the number of game instances to achieve a $50 prize, and the actual game experience presented to the player may be a random selection of the finite outcomes. For example, in the case where a COLLAPSE-type game is played wherein items are collected for playing in a second level game, such reveal outcomes of each instance of the COLLAPSE-type game may be stored on the server, for example, as an entry in the database of the server.

Alternatively, the result of each prize for each instance of the game may be determined dynamically by the client computer. For example, if the overall prize (e.g., $25) for the ticket is known, the client can determine (e.g., randomly) a distribution of winnings of the overall prize among game instances. In the example above, a play of the ticket on one computer could award a $25 prize among two game instances as follows: $5 prize for the first game instance and $20 for the second game instance. Another play of the ticket on the same or different computer may award a $25 prize differently among the two game instances (e.g., $10 for the first game instance, $15 for the second game instance, etc.). It should be appreciated, however, that the game may include any number of game instances, and the prize associated with each game instance may be stored in any storage location (e.g., at the client computer, at the server, etc.).

In addition, prizes may be awarded in association with each item collected in the game (e.g., a stick of dynamite in a COLLAPSE-type game). Therefore, prizes may be distributed among hidden items in the game grid as well as being distributed among game instances. In any case, the result of each game instance may be either stored at the server or may be determined randomly or dynamically by the client as discussed above.

Payouts may be determined by a pay table associated with the game. The number of tickets may be determined a priori, and a pay table that determines payouts may be allocated to the tickets. This allocation may be determined, for example, by shuffling the pay table and allocating results to tickets. The following is an example of a pay table that may be used with a game according to one embodiment of the invention:

TABLE I

Example Payout Table
Number of Tickets Issued: 2000
Ticket Price: $5

| Number of Tickets | Payout |
|---|---|
| 1 | $100 |
| 700 | $10 |
| 500 | $5 |
| 100 | $1 |
| 600 | $0 |
| Game Operator Return: $300 (3%) – expenses | |

As shown in the example above, a certain number of tickets may be allocated as winning tickets having a particular payout (e.g., an outcome). Some tickets may have no payout associated with them, and some may only have a nominal payout (e.g., a small award amount, free ticket, etc.). A small number of tickets may include a large payout as compared to the magnitude of other payouts. It should be appreciated, however, that payouts are not limited to money, but other types of prizes may be awarded including merchandise, credit, loyalty points or any other representation of value.

The odds of winning may be the type of odds experienced in actual (rather than computer-based) games. Alternatively, the odds of winning may not necessarily be "natural" odds of winning any particular type of game, but rather, the odds may be adjusted to obtain the outcome desired (e.g., by the gaming operator). The odds of winning, number of winning tickets, amount of payout per ticket, or other payout parameter may be any amount or number, and the invention is not limited to any particular odds of winning, number of winning tickets, payout amount or type of payout. However, according to one embodiment, the overall odds of winning, amount and type of payout, etc. may be similar to a game previously approved by regulators (e.g., scratch ticket games, Keno, Bingo, etc.) so that the use of an additional game to display an outcome associated with the previously-approved game is scrutinized much less by regulators, and as a result, the approval of the additional game is less burdensome. To this end, a system associated with the previously-approved game may provide ticket and outcome information to a system conducting an online game (e.g. server 103).

As discussed above, the code stored on the server (e.g., server 103) may be used to determine game play as played on the computer system. For example, the game outcome may be "Win $50." In the case of a slot machine-type game, the ticket may indicate that the player receives 10 spins of the slot machine. The outcome of each spin may be predetermined, and the game may retrieve information from the server indicating a predetermined sequence of game play as discussed above. In the case of a slot machine-type game, the predetermined sequence may indicate the winnings associated with each of the spins. In the case of a COLLAPSE-type game, the outcome of each instance of the second level game may be stored on the server and retrieved prior to game play.

In another example, only the overall outcome is predetermined (e.g., the total winning associated with the ticket), and the sequence of game play may be determined when the game is played. In the example above where the player is indicated as winning $50 over 10 spins, the $50 winnings (and any intermediate losses) may be allocated to the player at any point over the 10 spins. In the case of the COLLAPSE-type game, winnings may be allocated across game instances. In a further example, winnings may be allocated across items collected while playing the COLLAPSE-type game. Because the number of items collected may vary depending on the skill of the player, the distribution of prizes among collected items may be determined during game play by the game playing system. Thus, according to one embodiment, the player's skill (or lack thereof) does not affect the overall outcome of the game.

This allocation may be determined by the server, the game software executing on the client, or a combination thereof. Further, the game play may be randomized in that a further play using the same ticket may yield a different sequence of game states leading to the same outcome. For example, in the case of a slot machine game as described above, a player may be indicated as winning $50, but the sequence by which the player attains the $50 winning outcome may be different depending on various factors. Such factors may include a randomization function that determines results of individual game plays (e.g., in the case of a series of "spins," the result of each spin), or some other function. The series of intermediate outcomes may be stored in a database associated with the server as discussed above with respect to game outcomes. Also, the outcomes may be adjusted using a formula or rule-based approach during execution of the game to increase the game drama and heighten the game playing experience.

According to one embodiment of the present invention, the type of game that is played is immaterial to the outcome revealed to the player. More particularly, the same outcomes associated with a particular ticket may be used to drive multiple types of games. This allows, for example, the gaming operator to offer multiple types of games with a single ticket, and allows the player to select which game(s) to play to reveal the outcomes associated with the particular ticket. For example, the player may elect to play a slot machine game for a first game instance of a ticket, and for a second instance, play a COLLAPSE-type game. Of course, it should be appreciated that any type of game and other combinations of games are possible. In this manner, the player may be provided the flexibility to play particular games in which the player is interested, thereby increasing his/her interest and participation in the game. Further, the game operator is provided additional flexibility as new games may be introduced/substituted that are associated with the same ticket or other game piece.

According to another aspect of the present invention, a player may purchase a ticket at a point of purchase (e.g., a convenience store) and the indication of a win/no win condition of the ticket is revealed on a different medium. For example, a player purchases a scratch ticket in a convenience or other type of store. The prize that the player wins is not revealed on the scratch card itself, but rather the prize is revealed through another medium (e.g., on a home computer system, PDA, cell phone, etc.).

For example, as discussed above, the player may be presented another game (e.g., a slot machine or COLLAPSE-type game as described above) that reveals at least a portion of the prize. The underlying prizes available via the reveals may be predetermined, in that the outcome of the game may be stored in one or more systems. The scratch ticket may reveal different numbers of plays (e.g., pulls in the case of a slot-machine type game, or game instances of a COLLAPSE-type game) the player receives.

According to one embodiment of the present invention, wins are optimized across game instances associated with a ticket. For example, a ticket may have a predetermined outcome (for example, awarding a prize of $50), that may be allocated across the game instances associated with that ticket. For example, in the case of winning $50 on a 5-play (5 game instances) ticket, it may be desired to allocate the wins across game instances to provide a particular game experience. For example, the game experience of winning $50 may be distributed across five game instances (e.g., five separate games, respectively winning $5, $0, $0, $5, $40) to provide the player an early indication of winning. Also, the remaining game play of the game instances may be scripted to build the drama of the game experience while still retaining player interest. Such a scripted outcome is more interesting, according to one embodiment, as the player is presented an outcome in a way such that retains interest in the game. This is beneficial, as an overall result includes extending scratch-type games or other type of game experience beyond the point of sale, and beyond the instant (but fleeting) gratification associated with scratch-type or other instant ticket game experiences.

According to one embodiment, a player is permitted to wager and redeem bets at authorized locations (e.g., legal jurisdictions such as lottery retail establishments, casinos, and the like) while the online portion of the game may be played in any locale or jurisdiction. In such a case, the casino or lottery experience is extended to locations where otherwise lottery and/or casino games are not available. Thereafter, players return to the lottery or casino establishment to redeem their tickets thereby providing yet another opportunity to entertain the player.

According to yet another aspect of the present invention, winning results may be split across opportunities to win. One embodiment of the present invention relates generally to how wins are shown to the player across win opportunities. In one specific example, one embodiment relates to a method for revealing wins to a player across a play of multiple game instances that build excitement for the player and which holds the interest of the player in continuing to play the game. It is appreciated that the game experience may be made more compelling if wins are distributed among win opportunities in an interesting way.

Another method for maintaining the interest of players includes awarding additional opportunities to win with each ticket. For example, one of the prizes awarded with a particular opportunity to win (e.g., during the play of the game instance) may be one or more additional opportunities to win. For example, in a slot machine game, an issued ticket may be associated with five (5) spins. One of the prizes awarded with the ticket may include additional spins. At the time of initial ticket activation, it may be predetermined that the ticket is associated with these additional opportunities to win, and these additional opportunities may be associated with the issued ticket. The player, when playing the game, will obtain additional satisfaction in playing because the number of game instances to be played by the player are increased, and therefore, their opportunity to win is also increased. This may be beneficial to create a more realistic gaming experience (such as in casino slots) where additional spins may be awarded during casino play. However, unlike casino play wherein slot play can be continued from an online account or by placing additional bets to create a more continuous game experience, the additional spins are awarded to a single ticket.

In the case where an online game system is a Keno-based or other drawing-based systems wherein results are not predetermined, additional opportunities to win may be associated with the ticket in the form of additional numbers selected by a computer system and associated with the ticket at the time of a drawing. This may be performed, for example, by assigning one or more additional drawing entries as a prize itself in the pay table associated with the Keno or other drawing-based game. More particularly, the drawing entries may be awarded as prizes, which themselves are indexes into other entries in the same pay table. Such additional entries may correspond to one or more prizes. For example, when the drawing occurs, the additional plays are awarded to the drawing numbers associated with the ticket. These drawing numbers may be associated with a particular game instance, of which there may be many associated with one ticket. At the point when the ticket is activated by the result of the drawing and play of the online game is permitted, the player, upon the beginning of play of the ticket or a particular game instance, the player is awarded the additional plays (and therefore, any prizes) associated with these additional plays. The additional plays may be played as additional game instances, which themselves have additional reveal opportunities. Alternatively, additional reveal opportunities may be added to one or more other game instances to make game play more exciting.

In one aspect of the present invention, the ticket includes authentication information that is used to obtain the reveals. In one example, the scratch ticket contains a secret key which is used to decrypt the results that are revealed to the player. That is, according to one aspect, it is impossible to determine if and what a particular ticket wins without having possession of the ticket (and therefore the secret key). In another example, the scratch ticket could contain only a portion of the secret key. The other portion of the key may be stored, for example, on a server and retrieved from a database (e.g., file, relational database, etc.) based on, for example, the serial number of the card. Mappings of serial numbers of tickets to encrypted results can be provided to the lottery provider for additional audit control.

According to one embodiment of the present invention, the outcome of the game is predetermined at the time of ticket printing, issuance, or purchase or shortly thereafter. That is, the game outcome associated with a particular ticket is available prior to, at the same time, or shortly thereafter the ticket is provided to the player, after which time the player is permitted to play any games to reveal the predetermined outcome. In another embodiment, outcomes associated with tickets issued to the player are determined some time after the ticket issuance (i.e., outcomes are "post-determined"). Such is the case with Keno or other drawing-based games wherein game outcomes are determined after ticket issuance. In such a game, players are permitted to obtain the outcome at a predetermined time, usually after the player has purchased the ticket. In one aspect of the invention, it may be beneficial to have a later activation of tickets, especially in the case of a ticket-based game where tickets are issued in some other gaming environment (e.g., a casino). It may be desirable to only permit the player to play such a game outside the gaming environment so as not to compete with other games. Additionally, it may be desirable to require the player to revisit the gaming environment to redeem the ticket and increase the chances that the player will purchase additional tickets or play other types of games offered in the gaming environment.

Figure 4:
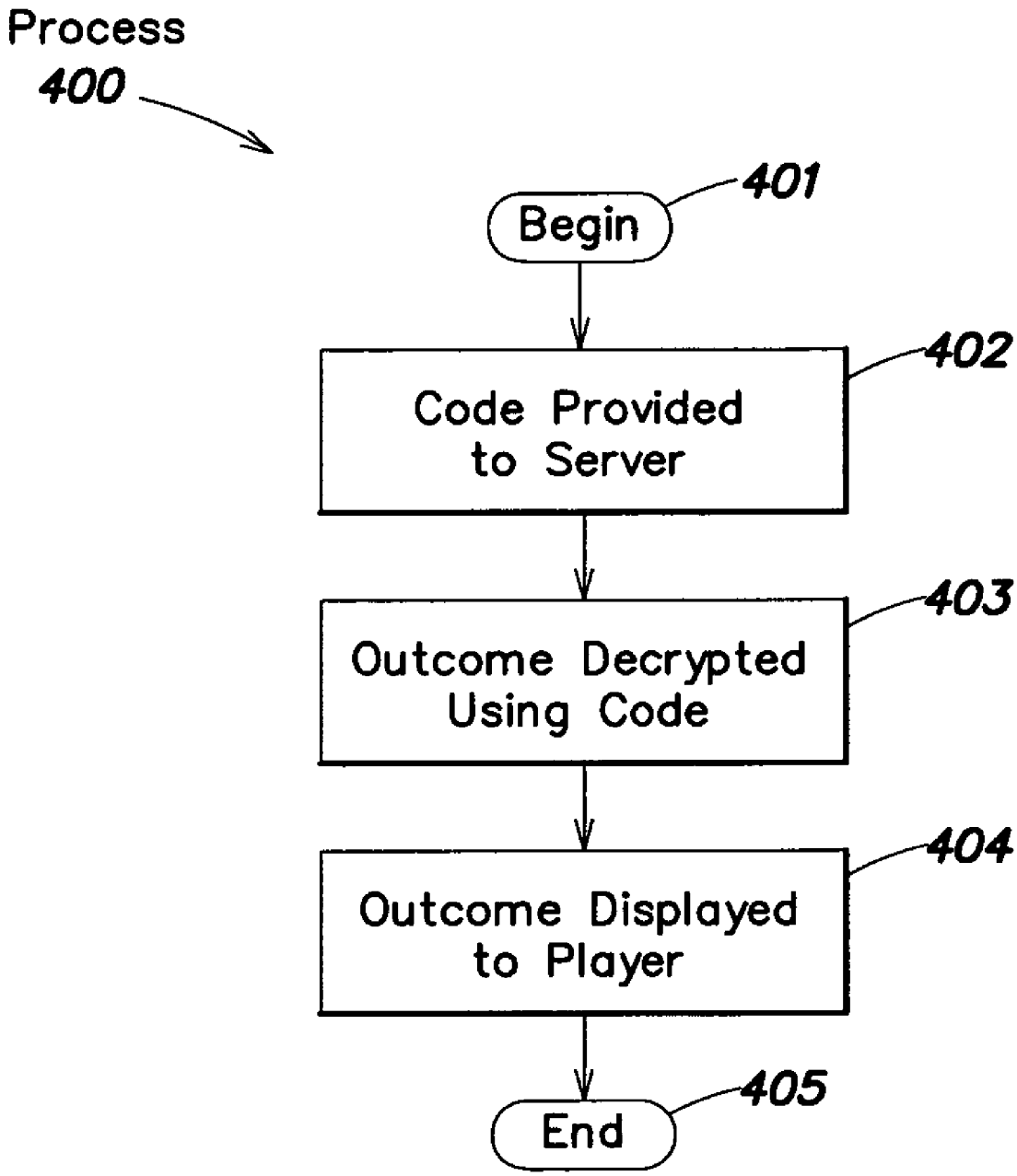
FIG. 4 is a flow chart of one example of a process for conducting a game according to another embodiment of the present invention.

A process for performing secure access to outcomes is shown in FIG. 4. At block 401, process 400 begins. A server (e.g., server 103) may store a number of outcomes in encrypted form, each of which outcomes can be accessed by a respective code. These outcomes may be encrypted, for example, using any encryption method (e.g., symmetric, asymmetric encryption) as is known in the art. At block 402, a code is provided to the server (e.g., server 103).

This code may be, for example, a secret code (e.g., a symmetric key, a private key) printed on a ticket and provided to the server by a user through an interface of a computer system as discussed above. The received code may be transmitted between systems using a secure transmission method (e.g., SSL) as is known in the art. The received code is used at block 403 to decrypt the outcome stored on the server. This code may be any decryption key type that may be used to decode data, and may be of any format or length. The decrypted outcome may then be presented to a player at block 405. The outcome may be displayed using any method. For example, as discussed above, the outcome may be presented through one or more reveals presented to the player during play of an online game. At block 405, process 400 ends.

Another aspect of the present invention relates to a lottery-based software game that can be played over a network, such as the Internet. According to one embodiment, the system includes a purchase of a scratch-based or printed ticket by a player at a point of service (POS). A POS may be, for example, a place at which lottery tickets may be sold, including convenience stores or other locations where lottery products are provided. In an alternative system provided at a casino or other gaming establishment, a ticket may be sold to a player at the casino for play at a later time.

The player receives the ticket at the POS or other location, and proceeds to play a computer-based game at another location to reveal a result (or outcome) of the game. The computer-based game may be, for example, a casino-type game (e.g. slot machine, video poker) or other type of game, including amusement games or games of chance. In the case of the scratch or printed ticket, the result is not apparent to the player until the player plays the computer-based game. This game may be, for example, a software program that is downloaded and played over the Internet. Alternatively, other ways of accessing the online portion of the game may be used (e.g., PDA, cell phone or other method).

The ticket includes a code by which a player gains access to a result stored on a server that stores ticket information and results associated with each ticket. Such information may be predetermined at the time of ticket sale, or the results may not be known until a later time, after the ticket is issued to the player (e.g., in the case of a Keno, Bingo, or other drawing-based system). According to one embodiment, the code is an access key (or a portion thereof) that is used to access the result stored on the server. Further, the result (stored in the server) may be encrypted. For example, the code may be a private key or a symmetric key. The key may be transmitted by a client computer system to the server for the purpose of decrypting the result using SSL or any other secure method.

Because the decryption key is stored on the ticket, the gaming system is safer, as a breach of security of either the tickets or the server does not provide access to result information. More particularly, access to the lottery ticket database may not be accomplished without the ticket (used to decrypt the result). Further, the tickets may not be correlated to results without the lottery ticket database (because the results are stored in the database, not on the tickets).

In another example of the system, a portion of the key used to decrypt results of the game is stored on the ticket, and another portion is stored in the database of the server. In this manner, it is assured that possession of either portion of the key may not compromise the results.

However, it should be appreciated that the system does not require SSL or any other encryption/decryption method, a decryption key on the ticket, or the stored result on the server to be encrypted. Rather, the game can be implemented with or without these features. That is, access to the outcome stored at the server may be performed using only the serial number or other ticket identifier printed on the ticket.

The scratch-based or printed ticket also includes a second serial number or other identifier (e.g., an access code) in addition to the serial number or other identifier which is correlated to results on the server. A ticket may include both a serial number and a ticket identifier used by the system. According to one embodiment, it is appreciated that there may be security issues with using the serial number of a printed ticket (as printed on the ticket) to correlate to win outcomes. That is, the lottery provider may not allow any entity outside of the lottery system to have the ability to correlate outcomes to serial numbers. To this end, another identifier (e.g., a separate ticket identifier or access code) may be provided on a ticket to allow the system to index into an outcome database.

In one example system that works in association with a lottery system, outcomes for a game may be predetermined to comply with lottery rules. In this case, outcomes are predetermined and stored in a database. In an alternative environment where results are not permitted to be predetermined (e.g., in a casino), but rather are determined at a later time (e.g., by a drawing or other method), a ticket issued by a system in such an environment may have an associated drawing time when a game may be played. In the case where the online game system is driven by a Keno game result, each ticket may be associated with a set of numbers in the Keno game, and the result of the Keno game is provided as the result for the online game. In one example, a computer system automatically picks numbers associated with the ticket at the point when the ticket is issued. Thereafter, when the Keno game occurs, the result of the Keno draw is provided to an online game system, which translates the Keno result to a game experience within another game (e.g., COLLAPSE, slot machine, etc.). It should be appreciated, however, that although the game of Keno may be used to drive an online game experience, other games (e.g., Bingo) may be used.

The server (e.g., server 103) may be capable of accepting, from the user, an input of the serial number and decryption key, and in response, providing the results associated with the particular ticket. The result or outcome of the game may be displayed to the player in an interface of the computer system (e.g., a client computer system such as a personal computer (PC)) used to play the computer-based game. For example, the outcome of a series of plays associated with the ticket may be stored in the server, and provided to the client, and the series of outcomes may be presented to the player during play of the computer-based game.

In another embodiment of the system, a payout of the ticket may be encoded on the ticket. For example, if the ticket is a $5 winner, the amount of the win may be encoded on the ticket. In the case of the casino-based version of the system, the payout may not be stored on the ticket (as the payout is not predetermined), but rather the purchase price of the ticket may be stored on the ticket, or some other identifier of the ticket.

Figure 5:
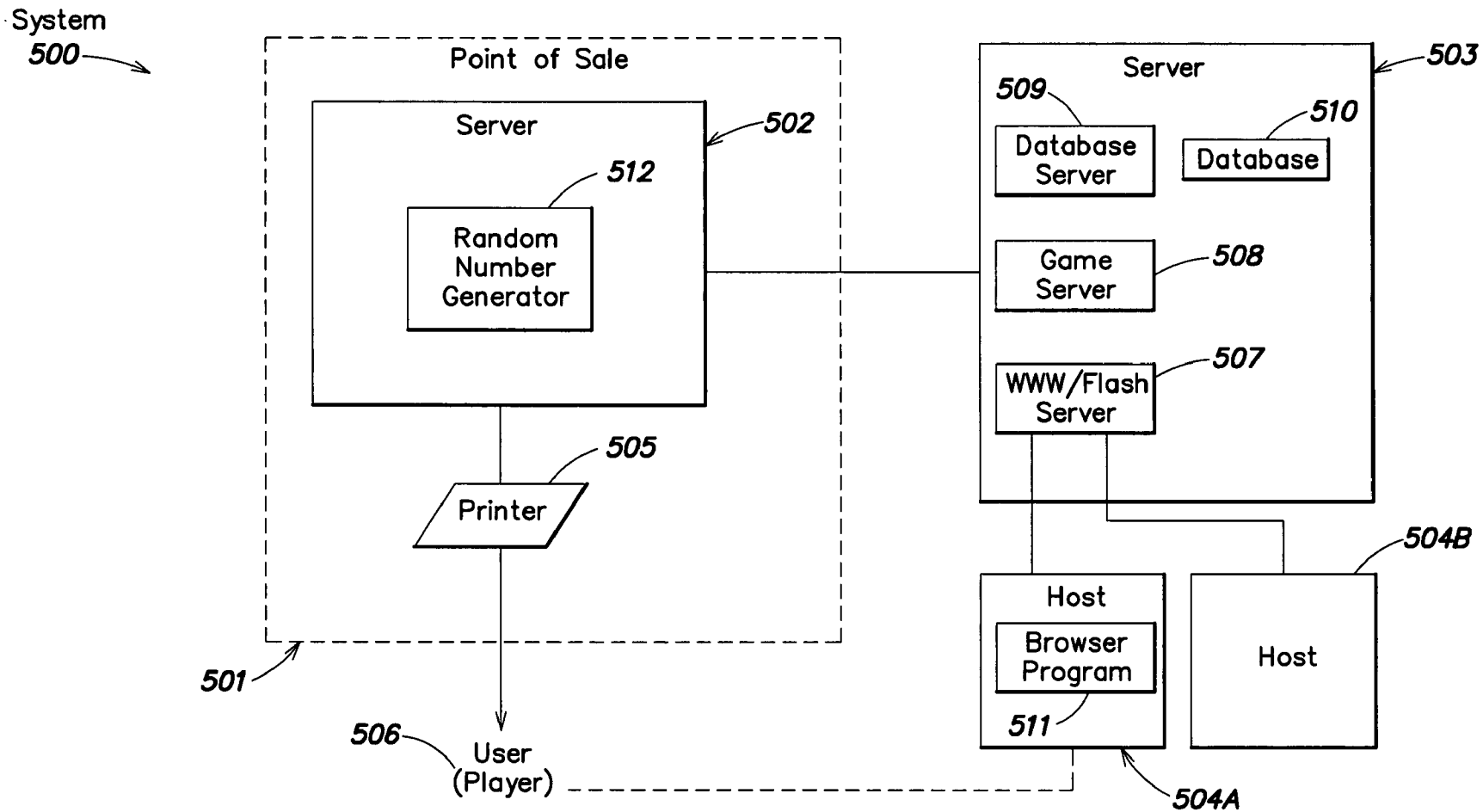
FIG. 5 is a block diagram of one example of a system for conducting a game according to according to one embodiment of the present invention.

As shown in FIG. 5, a system 500 may be provided having more than one server. For example, a server 502 provided at the point of sale 501 is primarily responsible with issuing tickets to a user/player 506. To this end, server 502 may issue preprinted tickets or may issue tickets printed from an associated printer 505. Such tickets may include one or more identifiers as discussed above with reference to FIGS. 2 and 7. As discussed, another system such as a Keno or lottery-based system may be used to provide results to an online game system.

In one version of system 500, the win/loss determination of a ticket may be driven by a later-occurring drawing. For example, a Keno-based, Bingo-based, or other type lottery draw system may be used wherein the outcome of a particular game is not known until a future time (e.g., when a drawing occurs). In this case, the ticket identifier stored on the ticket may be an access code generated from ticket identifiers in the Keno-based system (e.g., by an intermediate system or the Keno server itself that can translate a Keno ticket identifier into another type of identifier).

Generation of an identifier separate from the Keno ticket identifier may be necessary for security reasons relating to the Keno system. More particularly, access to the Keno ticket identifiers may not be permitted by the system (e.g., the Keno server). In one example, a Keno system translates Keno ticket identifiers into access codes and results that are stored on the game server (e.g., server 503). Thereafter, clients (e.g., hosts 504A, 504B) access results stored on the server based on their respective access codes.

As discussed above, one or more hosts 504A, 504B (e.g., general purpose computer systems) may communicate with a server 503 over a network for the purpose of conducting a game. In one example, a host 504A renders a browser window by executing a browser program (e.g., the Internet Explorer browser program available from the Microsoft Corporation).

A user/player 506 enters a URL address specified by an issued ticket in a window of the browser interface, and is directed to a website associated with server 503. This website may be rendered by, for example, a WWW server process (e.g., server 507) associated with server 503.

Player 506 may be instructed to enter an access code (and/or any other required information) to access one or more games in an interface presented through the browser. As discussed, server 503 may validate the received access code, and provide any results stored in a database associated with server 510. Once validated by server 503, the user may be permitted to play one or more games. These game may be, for example, be programmed using one or more programming languages (e.g., Macromedia Flash) and may be downloaded to host 504A and executed.

Also, outcomes associated with any games may be downloaded prior to game play. As discussed, examples of games include those that may be of the lottery-type (e.g., having a predetermined outcome) and those that are casino-based (e.g., having an outcome that is not determined at the time of sale of the ticket). In the case where a later drawing affects an outcome, a player may not be permitted to play the game until the drawing occurs (and until results are available at server 503). In the case of a drawing that affects outcomes, drawing results can be communicated from server 502 to server 503. In addition, server 502 may maintain a mapping from a ticket identifier (e.g., a serial number) to an access code provided on the ticket, and provide a mapping of outcome to access code when the drawing occurs. As discussed, such outcome information may be maintained in a database 510 associated with server 503 and may be accessed through a database server process 509.

As discussed, the payout of the lottery ticket may be displayed to a player in a number of ways. For example, the payout of the ticket may be presented to the player through one or more reveals presented to a player during one or more plays of an online game.

For example, in the case of a slot machine game, a player may be permitted, with the issue of a single scratch or printed ticket, a series of spins of the slot machine. The slot machine may, as the result of each of the spins, produce results that contribute to the overall payout to the player. For example, after a single spin, a player may be presented an indication that he/she has won $5. The payout to the player as provided from the server database may be, for the series of spins, $50 overall, with particular outcomes for each spin. Additional spin results may provide the additional $45 that the player will receive. Additional spins may add, subtract, or have no affect on the contribution to the outcome of the game. These results of each spin of the slot machine game may be stored in the database of the server indexed by the ticket identifier, or may be randomly determined by the game program that renders the game. Further, as discussed above, the results of each spin may be "scripted" such that the game experience is more exciting to the player.

For example, in the case where the results of each spin are stored on the server, the series of results may be downloaded to the client at the beginning of the game as a series of entries, and the client may reveal each result as the player progresses through the series of spins. In the random method, results for each individual spin are not predetermined, but rather are determined by the client in a random manner. For example, the actual outcomes of each spin may be randomly chosen among the possible combination of outcomes that may produce the required payout. In either case, the outcomes for each spin of the slot machine game is not stored on the ticket, but rather is stored at the server and downloaded just prior or during game play, or is determined randomly by the client. Alternatively, the client may determine the game experience based on a predetermined set of rules or formulas that, when an overall outcome is provided, allows the client to determine intermediate outcomes in a dynamic way.

Because the game play and outcome are scripted, a player may also not play the game (and possible secondary games) to actually win. A player may purchase a ticket, wait until the ticket may be redeemed, and go to a POS to find out (and if necessary, receive) his/her winnings. A ticket may be allowed to be redeemed after a predetermined period of time after the drawing independent of whether the player has played the game. A ticket may be able to be redeemed after a predetermined period of time, from almost immediately to seconds to days or any predetermined time. For tickets with results dependent upon results of a particular Keno game or other event, the ticket may not be redeemed until after the event has passed.

Finally, after play of the online game, the player is permitted to validate the ticket at any POS location (e.g., 501 (for example, a lottery agent, casino, or other gaming establishment) to redeem his/her winnings as indicated during the online portion of the game. According to one embodiment, players are permitted to redeem their winnings only after playing the online portion of the game. The player, by playing the online portion of the game, sets status information at the server (e.g., server 503). When the player attempts to redeem the ticket at the POS (e.g., 501), the status information may be checked, and the player is permitted to redeem his/her winnings. To this end, server 503 may communicate information back to server 502 relating to game play.

For example, server 503 may collect information that indicates the sequence of game play performed at the client, and other player tracking information. In one example, tickets may be associated with a particular player, and the player may be awarded loyalty points or other credit for playing the game.

Taking a COLLAPSE-type game, a player is issued a ticket at a POS to play one or more instances of the COLLAPSE-type game. The ticket indicates an access code, and the player uses this access code to gain access to the system (e.g., from a host coupled to server 503 through the Internet). The player enters the access code in a user interface, and, once validated, is permitted to play the COLLAPSE-type game. Optionally, the player is permitted to play, based on a single access code (and ticket), any one of a number of games available from server 503. Such an option may allow a player to play different games for each game instance associated with the ticket.

According to one aspect of the present invention, it is realized that the time at which tickets are activated (and therefore, may be played) is important. In the case of a casino-based game, where tickets are issued at the casino, it may be beneficial to include a delay between the purchase of a ticket and a possible redemption of the ticket so that the game play associated with the ticket does not compete against other games offered by the casino (e.g., floor games). For example, in the case of a slot machine game, it may be preferable that such a game be activated after the player leaves the casino, or otherwise is not playable while in the casino so as not to compete with other types of slot machine games or other game types offered by the casino.

Further, another benefit of introducing a delay between ticket issuance and activation includes increasing the likelihood that the player plays the game at another location (e.g., at home), requiring the return of the player to the ticket redemption location to redeem his/her winnings. Because the player needs to return to the redemption location (which may be a casino), the possibility that the player will purchase additional tickets or play other types of games offered at the redemption location is increased.

Thus, referring again to FIG. 3, once played, the player may redeem the ticket at the point of sale or other redemption location at block 308. Alternatively, the player may be permitted to redeem the ticket without playing the game.

Redemption may be permitted, for example, after a predetermined time. For example, the player may be permitted to redeem a ticket after a set time (e.g., 10 PM), a particular time period after ticket purchase (e.g., 24 hours) or other absolute or relative time. This may be the case for a Keno or lottery-based system, where a Keno or lottery result is made available at a set time after ticket purchase. Alternatively, tickets may be redeemed immediately after purchase. At block 309, process 300 ends.

For the purposes of example, according to one embodiment of the present invention, a COLLAPSE-type game is conducted that may include the following additional aspects, either alone or in combination:

The game begins with a fixed number of lines of colored elements already positioned on the game grid (e.g., grid 601) and available to be selected by the user (or player).

New elements fill the bottom and/or the top of the screen, from left to right, one at a time, but are not available to be selected. When a row is complete, the line of elements is pushed onto the game grid and added to those elements in active play. Alternatively, new elements may fill the game grid from any edge, including from the right and/or left side.

Selecting the preview area as lines are being formed causes the preview area to fill with elements and the elements to be added to the active play area.

The user can clear elements from the active area by selecting any three or more same-colored elements that are touching.

When a user positions a selection device (e.g., a mouse pointer) over a group of elements that are eligible to be cleared, the group of elements changes in appearance.

When elements are cleared, the elements above fall downward and toward the center to fill any void created by removed elements.

When the user clears an element that contains a dynamite stick (or other item) in it, that stick is placed to the right of the game board for use in the second level game (e.g., a prize round).

When the stack of elements comes within a predetermined number (e.g., three) of rows of the top of the game area, a warning area flashes.

If the elements reach the top of the game area, the COLLAPSE-type game ends and the user is taken to the second level game.

If the user collects a predetermined number (e.g., six) of dynamite sticks, the COLLAPSE-type game ends, and the user is taken to the second level game.

The user begins the game with one dynamite stick collected for him/her.

At the second level game, the user is presented with a grid, 6 by 6, of safes.

The user selects a button and the first dynamite stick is used.

The stick begins at the top left most safe and moves over each safe in turn, from left to right, top to bottom, one at a time.

The safe that the stick stops at is blown open to reveal either a cash amount or other prize type or an indication that no prize is awarded.

If multiple sticks are available for use, each subsequent stick starts at the safe immediately after the safe that was blown open.

The sticks skip over safes that have already been opened.

At the conclusion of the game, the user is presented an indication that the second level game is over and an indication of any prize(s) awarded.

The overall result (e.g., payout) for purchasing a ticket may be predetermined (as in a scratch or other type of instant lottery game) or may be determined by a later event (such as a lottery, Keno, or Bingo draw) that occurs after ticket issuance.

Having thus described several aspects of at least one embodiment of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

What is claimed is:

1. A method for playing a game of chance comprising acts of:

issuing a pull-tab ticket to a player, the ticket including a code printed beneath a pull-tab cover of the ticket on an outside surface of the ticket, the ticket having thereon a ticket based game of chance, wherein ticket combinations indicating a result of the ticket based game are printed in a hidden location on an inside surface of the ticket that is a different surface than the outside surface, the ticket based game having an overall prize value;

determining, subsequent to issuing the pull-tab ticket to the player, the result of the ticket based game;

providing for the player to play a plurality of game instances of a computer based game that is a different game than the ticket based game on a different medium than the issued ticket;

providing for the player to obtain, from play of the computer based game, a result of the ticket based game of chance using the code to reveal the result of the ticket based game during play of the computer based game, wherein a plurality of prizes awarded in response to play of at least one of the plurality of game instances of the computer based game accumulate to form the overall prize value of the ticket;

wherein the result of the ticket based game that is revealed during play of the computer based game is a different result than a result of the computer based game and play of the computer based game does not affect the result of the ticket based game;

requiring the player to perform an action to reveal the code wherein this action does not reveal the ticket combinations; and wherein the inside surface of the pull-tab ticket containing the ticket combinations is sealed and the outside surface of the ticket is free of perforations and cutting lines and does not reveal that the ticket may be opened to access the ticket combinations printed in the hidden location, such that the player plays the computer based game to reveal the result of the ticket based game of chance.

2. The method according to claim 1, wherein the different medium is a computer system.

3. The method according to claim 2, wherein the act of providing for the player to obtain the result of the ticket based game of chance includes:

providing an interface to the computer system to allow the player to enter the code; and permitting access to the result of the ticket based game of chance by using the code as a decryption key to obtain the results form the computer based game.

4. The method according to claim 3, further comprising an act of storing, on a server associated with the computer system, the result of the ticket based game of chance.

5. The method according to claim 4, further comprising storing, in a database associated with the computer system, a portion of the decryption key, the portion being used along with the code by the computer system to obtain the result of the ticket based game of chance.

6. The method according to claim 5, further comprising an act of obtaining, from the database, the portion of the decryption key based on an identifier printed on the ticket that uniquely identifies the ticket.

7. The method according to claim 1, further comprising an act of revealing the result of the ticket based game on the inside surface of the ticket when the ticket is opened.

8. The method of claim 7, comprising:

cutting open the ticket to reveal the result of the ticket based game on the inside surface of the ticket.

9. A pull-tab ticket, the ticket comprising:

a ticket based game of chance printed on the ticket and having an overall prize value;

an access code printed on an outside surface of the ticket that directs a player to a computer based game that is a different game than the ticket based game; and at least one ticket combination that determines a result of the ticket based game of chance printed in a hidden location on an inside surface of the ticket, wherein the outside surface of the ticket and the inside surface of the ticket are different surfaces, wherein the ticket combination that determines the result of the ticket based game of chance is based in part on an outcome of a plurality of game instances of the computer based game, and wherein at least one price awarded in response to play of at least one of the plurality of game instances of the computer based game accumulates to form the overall prize value of the ticket;

wherein obtaining the access code does not reveal the at least one ticket combination; and wherein the inside surface of the ticket containing the at least one ticket combination is sealed and the outside surface of the ticket is free of perforations and cutting lines and does not reveal that the ticket may be opened to access the at least one ticket combination printed in the hidden location, such that the player plays the computer based game to reveal the result of the ticket based game of chance.

10. The pull-tab ticket according to claim 9, wherein the pull-tab ticket includes no obvious means for opening the pull-tab ticket to reveal the ticket combination printed in the hidden location.

11. The pull-tab ticket according to claim 10, wherein the access code is printed beneath a scratchable surface, the scratchable surface being located beneath a pull-tab cover.

12. The pull-tab ticket according to claim 9, wherein the outside surface of the ticket is free of instructions to indicate that the result of the ticket based game is on the inside surface.

13. The pull-tab ticket according to claim 12, wherein the access code is printed on the outside surface of the ticket, beneath a pull-tab cover of the pull-tab ticket.

14. The pull-tab ticket according to claim 13, wherein the inside surface of the ticket reveals the hidden location when the ticket is opened.

15. A gaming system comprising:

a pull-tab ticket that includes an access code printed on an outside surface of the pull-tab ticket, the pull-tab ticket having a ticket based game of chance thereon, wherein the pull-tab ticket further includes ticket combinations indicating a result of the ticket based game of chance printed in a hidden location on an inside surface of the pull-tab ticket and wherein the outside surface of the pull-tab ticket and the inside surface of the pull-tab ticket are different surfaces and obtaining the access code does not reveal the ticket combinations, the ticket based game of chance having an overall prize value;

a computer system including a storage element an a game program that controls play of a plurality of game instances of a computer-based game that is a different game than the ticket based game;

an interface that enables a player to play the plurality of game instances of the computer-based game and that is adapted to accept the access code, wherein the computer system is adapted to provide the result of the ticket based game of chance in response to the player playing the computer-based game, wherein at least one prize awarded in response to play of at least one of the plurality of game instances of the computer based game accumulates to form the overall prize value of the ticket based game of chance and the result of the ticket based game that is revealed during play of the computer based game is different than a result of the computer-based game and play of the computer based game does not affect the result of the ticket based game; and wherein the inside surface of the pull-tab ticket containing the ticket combinations is sealed and the outside surface of the ticket is free of perforations and cutting lines and does not reveal that the ticket may be opened to access the ticket combinations printed in the hidden location, such that the player plays the computer based game to reveal the result of the ticket based game of chance.

16. The gaming system according to claim 15, wherein the result of the ticket based game of chance is stored on the storage element and wherein the computer system is further adapted to provide the result of the ticket based game of chance to the player by using the access code as a decryption key to obtain the result from the computer-based game.

17. The gaming system according to claim 16, wherein the ticket based game of chance has an associated prize and wherein a prize total for the pull-tab ticket is determined prior to issuing the pull-tab ticket to the player.

18. The gaming system according to claim 15, further comprising a retrieval element that retrieves the results of the ticket based game of chance in response to entry of the access code at the interface.

19. The gaming system according to claim 18, further comprising a revelation element that creates a sequence of reveals of prizes in response to retrieval of the results of the ticket based game of chance.

20. The method according to claim 1, further comprising an act of revealing the result of the ticket based game on the inside surface of the ticket, wherein the outside surface of the ticket is free of instructions to indicate that the result of the ticket based game is on the inside surface.

21. The gaming system according to claim 15, wherein the outside surface of the ticket is free of an indication that the result of the ticket based game is on the inside surface.

22. The gaming system according to claim 21, wherein the outside surface of the pull-tab ticket reveals the access code when a pull-tab cover is removed from the pull-tab ticket.

23. The gaming system according to claim 22, wherein the inside surface of the ticket reveals the result of the ticket based game of chance when the ticket is opened.

* * * * *